US007686399B2

(12) United States Patent
Heidmann et al.

(10) Patent No.: US 7,686,399 B2
(45) Date of Patent: Mar. 30, 2010

(54) SEATING WITH SHAPE-CHANGING BACK SUPPORT FRAME

(75) Inventors: Kurt R. Heidmann, Grand Rapids, MI (US); Gordon J. Peterson, Rockford, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 12/206,293

(22) Filed: Sep. 8, 2008

(65) Prior Publication Data

US 2009/0058160 A1 Mar. 5, 2009

Related U.S. Application Data

(63) Continuation of application No. 11/363,069, filed on Feb. 27, 2006, now Pat. No. 7,422,287.

(60) Provisional application No. 60/659,688, filed on Mar. 8, 2005.

(51) Int. Cl.
*B60N 2/00* (2006.01)
*A47C 3/00* (2006.01)

(52) U.S. Cl. ..... 297/354.1; 297/284.4; 297/452.56

(58) Field of Classification Search ..... 297/285, 297/291, 301.1, 284.4, 452.56, 354.1
See application file for complete search history.

(56) References Cited

U.S. PATENT DOCUMENTS 868,052 A * 10/1907 Wilmot ..... 297/320
2,471,024 A 5/1949 Cramer
3,540,777 A 11/1970 de Beaumont
3,565,482 A 2/1971 Blodee
3,929,374 A 12/1975 Hogan et al.
3,938,858 A 2/1976 Drabert et al.
4,181,357 A 1/1980 Swenson et al.
4,226,473 A 10/1980 Johnson
4,451,085 A 5/1984 Franck et al.

(Continued)

FOREIGN PATENT DOCUMENTS

DE 101 26 204 12/2002

(Continued)

OTHER PUBLICATIONS

WO 87/03256, Boulay, Jun. 4, 1987.*

*Primary Examiner*—Sarah B McPartlin
(74) *Attorney, Agent, or Firm*—Price, Heneveld, Cooper, DeWitt & Litton, LLP

(57) ABSTRACT

A back includes an integrated articulating back frame and a back support. The back frame has a lower segment pivoted to a chair control, an upper segment for thoracic support, and links forming a four-bar linkage with the upper and lower segments, with a joint being formed at the lumbar region. The back support is stretchable in limited directions to accommodate shape change in the articulating back frame but to provide adequate support to a seated user. Upon receiving a rearward pressure on the lumbar joint, the back frame itself changes shape. The pivot locations in the four bar linkage create a mechanism that simultaneously controls rotational and translational movement of the upper segment during flexure of the lumbar. The back frame is close to the back support to provide significant design flexibility, but permit substantial lumbar flexure. Various back supports are contemplated that accommodate articulation of the back frame.

9 Claims, 16 Drawing Sheets

U.S. PATENT DOCUMENTS 4,452,486 A 6/1984 Zapf et al.
4,509,793 A 4/1985 Wiesmann et al.
4,585,272 A 4/1986 Ballarini
4,765,679 A 8/1988 Lanuzzi et al.
4,830,429 A 5/1989 Petitjean
4,834,454 A 5/1989 Dicks
4,854,641 A 8/1989 Reineman et al.
4,878,710 A 11/1989 Tacker
5,037,116 A 8/1991 Desanta
5,100,200 A 3/1992 Keusch et al.
5,193,880 A 3/1993 Keusch et al.
5,308,145 A 5/1994 Koepke et al.
5,340,191 A 8/1994 May
5,423,593 A 6/1995 Nagashima
5,452,868 A 9/1995 Kanigowski
5,630,647 A 5/1997 Heidmann et al.
5,636,898 A 6/1997 Dixon et al.
5,860,701 A 1/1999 Jungjohann et al.
5,868,467 A 2/1999 Moll
5,871,258 A 2/1999 Battey et al.
5,873,634 A 2/1999 Heidmann et al.
5,947,558 A 9/1999 Suzuki et al.
6,086,153 A 7/2000 Heidmann et al.
6,135,559 A 10/2000 Kowalski
6,149,236 A 11/2000 Brauning
6,412,869 B1 7/2002 Pearce
6,474,737 B1 11/2002 Canteleux et al.
6,517,156 B1 2/2003 Lin
6,523,898 B1 2/2003 Ball et al.
6,536,841 B1 3/2003 Pearce et al.
6,609,755 B2 8/2003 Koepke et al.
6,669,292 B2 12/2003 Koepke et al.
6,669,294 B2 * 12/2003 Kinoshita et al. ..... 297/354.1
6,679,553 B2 1/2004 Battey et al.
6,695,404 B2 2/2004 Bruske
6,709,058 B1 3/2004 Diffrient
6,808,234 B2 10/2004 Bauer et al.
6,913,316 B2 * 7/2005 Kinoshita et al. ..... 297/300.3
2002/0180248 A1 12/2002 Kinoshita et al.
2003/0151287 A1 8/2003 Ueda et al.
2004/0012237 A1 1/2004 Horiki et al.
2004/0183348 A1 9/2004 Kniese
2005/0275263 A1 12/2005 Norman et al.

FOREIGN PATENT DOCUMENTS

JP 406327539 11/1994

* cited by examiner

SEATING WITH SHAPE-CHANGING BACK SUPPORT FRAME

CROSS REFERENCE TO RELATED APPLICATIONS

This application is a continuation of application Ser. No. 11/363,069, filed Feb. 27, 2006, now U.S. Pat. No. 7,422,287 entitled SEATING WITH SHAPE CHANGING BACK SUPPORT FRAME, which in turn claims benefit of provisional application Ser. No. 60/659,688, filed Mar. 8, 2005, entitled SEATING WITH SHAPE-CHANGING BACK SUPPORT STRUCTURE, under 35 USC 119(e), the entire contents of which are incorporated by reference. This application is also related to a utility application Ser. No. 11/363,067, filed Feb. 27, 2006, entitled SEATING WITH SHAPE-CHANGING BACK SUPPORT FRAME, which in turn also claims benefit of the provisional application Ser. No. 60/659,688, the entire contents of both of which are incorporated herein by reference.

BACKGROUND

The present invention relates to seating units having a back with back support structure adapted to change shape.

An ergonomic back construction is disclosed in Battey et al. U.S. Pat. No. 5,871,258 (hereafter the "Battey '258 patent"). The back construction in the Battey '258 patent includes a back shell positioned in front of and pivoted to an inverted U-shaped back frame at top and bottom pivots. The back shell includes a flexible lumbar section that combines with stiff thoracic and pelvic sections to cause the back to flex along a well-defined predetermined path. A biasing mechanism biases the lumbar section forwardly for optimal support to a seated user. Notably, in Battey '258, the bottom pivots are located on flanges (134) that extend forward of a front surface of the back shell, in a position where they limit overall design options and potentially interfere with laterally sliding onto the seat from a side position. It is desirable in some environments and some seating applications to eliminate interference to lateral entry onto the seat caused by the forwardly-extending flanges. Also, in Battey '258, the back frame is spaced rearwardly of and is exterior to the back shell in order to provide room for the back shell to flex. It is desirable to eliminate the need for a back frame spaced rearwardly from the back shell, since this limits design options and flexibility in regard to chair appearance. At the same time, it is desirable to maintain the ergonomic function and comfortableness of a flexible back shell construction similar to the one shown in the Battey '258 patent. Accordingly, increased design flexibility is desired for both aesthetic and functional aspects, such as to allow relocation or elimination of the top and/or bottom pivots, while maintaining a relatively simple mechanical assembly and while using environmentally-safe and environmentally-friendly ("green") parts that can be readily disassembled and recycled.

Thus, a system having the aforementioned advantages and solving the aforementioned problems is desired.

SUMMARY OF THE PRESENT INVENTION

In one aspect of the present invention, a seating unit includes a base, a seat supported on the base, and a back construction operably supported on the base for movement between an upright position and a recline position. The back construction includes a back frame and a back support defining thoracic, pelvic, and lumbar regions on the back frame in a vertical arrangement where a front surface of the thoracic, pelvic, and lumbar regions define a first curved shape with the lumbar region protruding forwardly. The back frame includes at least one multi-link arrangement incorporating components pivotally interconnected to flex and change shape in order to move the lumbar region rearwardly while continuing to support the thoracic and pelvic regions upon receiving a rearward lumbar pressure from a seated user. By this arrangement, when the back construction receives rearward lumbar pressure, the back support and back frame change from the first curved shape to define a more planar second shape.

In another aspect of the present invention, a seating unit includes a base, a seat supported on the base, and a back construction operably supported on the base for movement between an upright position and a recline position. The back construction defines a thoracic region, a pelvic region, and a lumbar region between the thoracic and pelvic regions with the lumbar region being located at least partially forward of the thoracic and pelvic regions. The back construction includes an upper rigid support structure with a front surface defining part of the thoracic region, a lower rigid support structure that is pivoted to one of the base and seat. The first and second rigid links are each pivoted at their upper ends to the upper rigid support structure at first and second upper pivots and each pivoted at their lower ends to the lower rigid support structure at first and second lower pivots. The first and second upper pivots define an upper first distance therebetween, and the first and second lower pivots define a lower second distance therebetween that is greater than the first distance. The upper and lower rigid support structures and the first and second rigid links are interconnected so that, when a seated user applies rearward pressure to the lumbar region, the back construction changes shape to define a more planar shape.

In another aspect of the present invention, a back construction for a seating unit includes a back frame and a back support supported on the back frame. The back frame includes at least one multi-link mechanism incorporating separate upper and lower segments. The upper segment forms an upper link of the multi-link mechanism and in combination with the back support is configured and adapted to at least in part provide support to an upper back of a seated user. The lower segment forms a lower link of the multi-link mechanism. The multi-link mechanism includes additional links that in combination with the back support are configured and adapted to at least in part provide support to a lower back of the seated user.

In another aspect of the present invention, a seating unit has a seat, a back frame, a back support supported by the back frame and having a surface adapted to support a seated user, a first energy mechanism biasing the back frame and back support toward an upright position, and a second energy mechanism adapted to bias a portion of the back support toward a forwardly protruding shape. An improvement includes the back frame defining upper and lower segments, with the second energy mechanism being disposed to bias an intermediate portion of at least one of the upper and lower segments of the back frame forwardly.

In yet another aspect of the present invention, a back construction for a seating unit includes a back frame adapted to support a back support and defining upper and lower segments operably interconnected to define a lumbar joint therebetween proximate a lumbar region of a seated user. The joint is located in a forwardly protruding position on the back frame, but is adapted to articulate and move rearwardly as the seated user presses rearwardly against the lumbar region. The back frame has a lower portion adapted for attachment to a base and is constructed to provide primary structural support for weight and movement of the upper rigid segment when the lumbar joint is flexed.

In another aspect of the present invention, a seating unit includes a base, and a back construction including a lower frame segment supported on the base and an upper frame segment supported by the lower frame segment. The upper frame segment defines at least one first pivot defining a first pivot axis and at least one second pivot defining a second pivot axis spaced horizontally from the first pivot axis. One of the base and lower frame segment define a structural support for the upper frame segment. A mechanism interconnects the first and second pivots to the lower structural support, the mechanism being configured to simultaneously control both rotation and also rearward movement of a lower part of the upper frame segment upon pressure against the lower part of the upper frame segment by a seated user.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
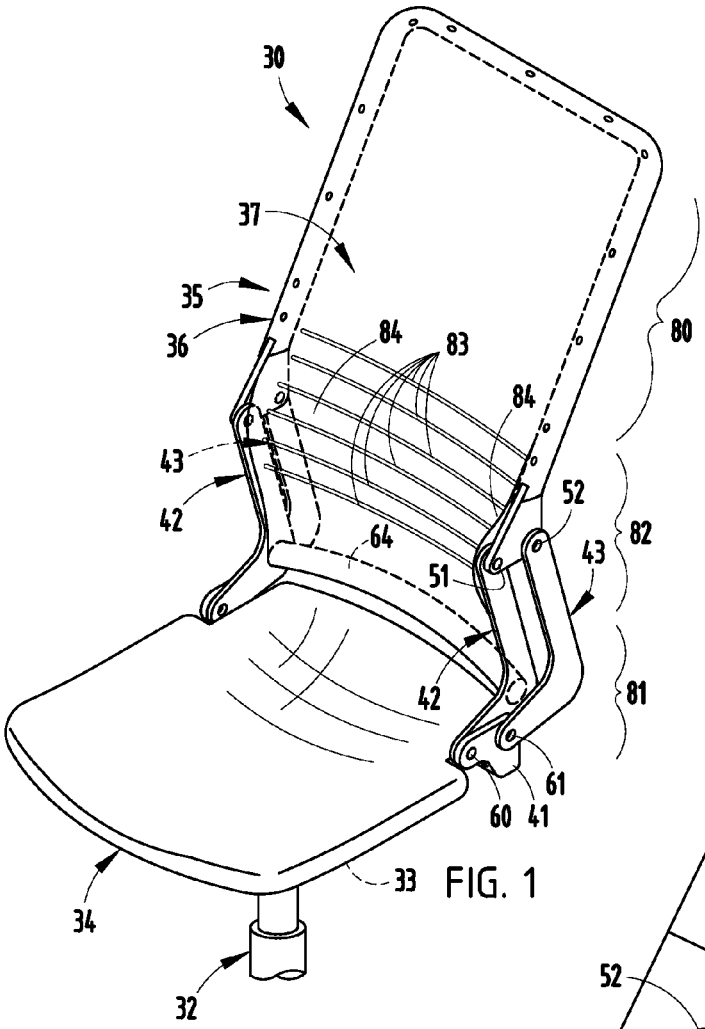
FIGS. 1-2 are perspective and side views of a seating unit embodying the present invention, the dashed lines in FIG. 2 showing the lumbar joint of the articulating back frame flexed rearwardly and showing a compliant back support supported on the back frame.

A seating unit 30 (FIG. 1) includes a base 32 with an underseat control 33 positioned atop a height-adjustable column, and a seat 34 and back assembly 35 (also called a "back" herein) operably supported on the control 33 for synchrotilt movement upon recline of the back 35. The back 35 includes an integrated articulating back frame 36 and a back support 37 attached to and supported by the back frame 36. In particular, the back frame 36 has an upper segment 40 and a lower segment 41. The lower segment 41 (FIGS. 4 and 4A) is pivoted to the chair control 33. The upper segment 40 is adapted to provide thoracic support to a seated user. Front and rear links 42 and 43 combine to form a four-bar-linkage arrangement with the upper and lower segments 40 and 41. A joint 69 is formed at the lumbar region of the back frame 36, and the back support 37 is compliant and accommodating of a shape change to the back frame 36. In particular, the back support 37 is stretchable vertically to accommodate the shape change in the articulating back frame 36, but is generally not stretchable in a horizontal direction along the back support 37 in order to provide adequate support to a seated user. Upon receiving a rearward pressure on the lumbar joint 69, the back frame 36 itself changes shape. Notably, the pivot locations defined at tops and bottoms of the links 42 and 43 create a mechanism that simultaneously controls rotational and translational movement during flexure of the lumbar. Since the back frame 36 is integral to the back 35 and not spaced from the back support 37, it provides significant design flexibility by allowing a "thin" back profile design, such as one that is only about 2 inches or so thick. It is noted that a variety of different back frame constructions are contemplated, and also a variety of different back supports are contemplated that will accommodate the articulating flexure of the present back frames.

It is contemplated that the present back construction 35 can be used on a variety of different bases, controls, seats, and armrests. Accordingly, the present inventive concepts are not believed to be limited to only the disclosed embodiments.

As noted above, the articulating back frame 36 (FIG. 4A) includes upper and lower segments 40 and 41 interconnected by a multi-link mechanism including two links 42 and 43 on each side. The upper segment 40 defines an inverted U-shape, and as illustrated, includes a U-shaped bent tube with pivot-defining brackets 50 welded to each end. The illustrated brackets 50 are stamped components that fit into slots in the ends of the segment 40. The brackets 50 each include forward holes defining an upper forward pivot axis 51 and rearward holes defining an upper rearward pivot axis 52. The location of the axes 51 and 52 can be varied depending on the requirements of back flexure. The illustrated axes 51 and 52 are about 1½ inches apart.

The lower segment 41 (FIG. 4A) includes a cross bar 55 with up-formed flanges 56 at each end. Two legs 57 extend forwardly from the cross bar 55 at spaced apart locations, the legs 57 extending a distance sufficient to connect to the control 33. The legs 57 each include pivot-defining structure 58 forming a back tilt axis 59, at which is located the axis of rotation about which the back 35 rotates upon recline of the back 35 from an upright position toward a recline position. It is noted that the present back 35 can be used on a seating unit (such as an office chair) that provides synchronous motion of the seat and back upon recline or on a seating unit that only provides back recline. The present back 35 can also be used on a seating unit that does not provide any back recline. Controls for providing synchronous seat and back motion upon back recline are well known in the art, and a specific disclosure of such a control is not necessary for an understanding of the present inventive concepts. Nonetheless, it is contemplated that part of the present inventiveness is a combination of the present novel concepts with a seating unit having a synchrotilt control for its seat and back. The up flanges 56 include holes defining a lower forward pivot axis 60 and a lower rearward axis 61. The location of the axes 60 and 61 can be varied depending on the requirements of back flexure. The illustrated axes 60 and 61 are about 2 inches apart.

Figure 11:
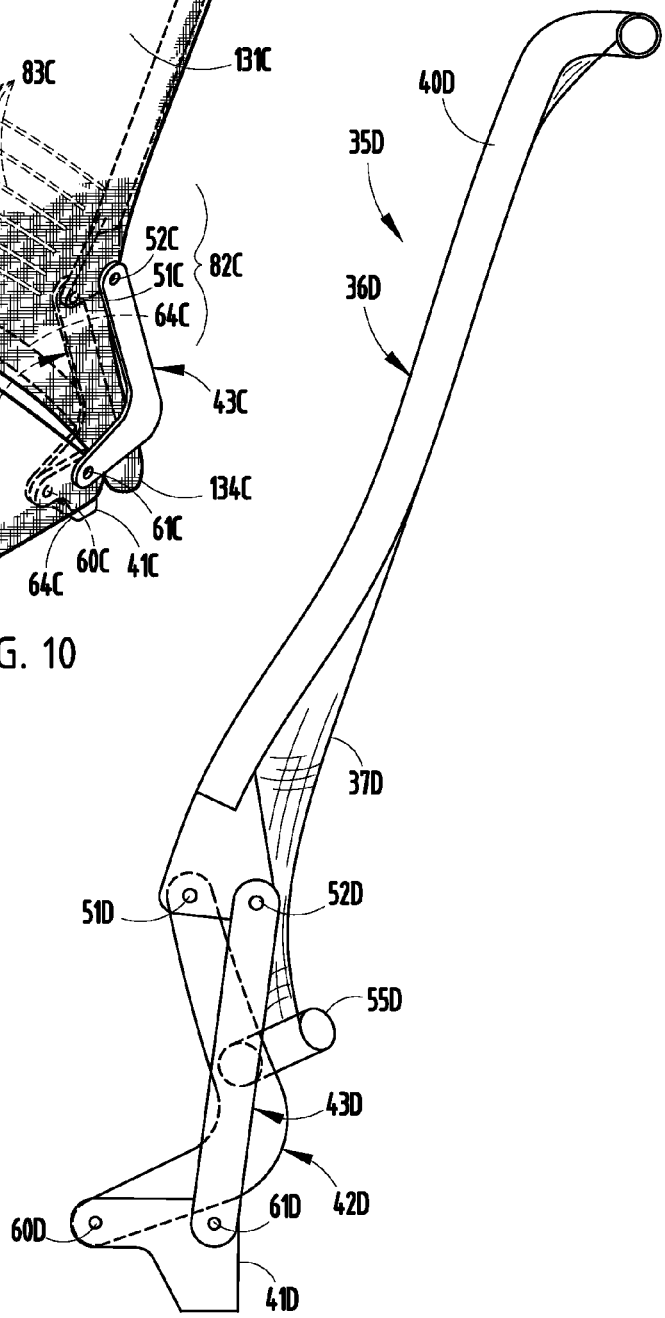

Front link 42 (FIG. 4A) includes right and left vertically-extending link components 63 and a cross tube 64 welded to and interconnecting the link components 63. The link components 63 are stamped parts having an L-shaped side profile that positions the cross tube 64 at a desired rearward location. Also, the L-shape of the link components 63 positions an intermediate portion of the link components downwardly and rearwardly of a seated user, thus maintaining an open side access to the seating unit 30. Nonetheless, it should be understood that differently shaped links can be used. For example, see link 43D which is linearly shaped (FIG. 11). The link components 63 (FIG. 4A) are pivoted to the brackets 50 of the upper segment 40 by aligned pivot pins 68 that extend along front upper axis 51 to define a lumbar joint 69. The link components 63 are pivoted to the lower segment 41 by pivot pins 70 that extend along front lower axis 60.

The rear link 43 (FIG. 4A) includes right and left components that may or may not be interconnected by a cross tube, depending on the functional and structural requirements of the seating unit being constructed. The illustrated rear links 43 are not connected. They are L-shaped stampings that extend vertically. The rear links 43 are each pivoted to the end brackets 50 of the upper segment 40 by aligned pivot pins 71 that extend along rear upper axis 52, and are pivoted to the up flanges 56 of the lower segment 41 by aligned pivot pins 72 that extend along rear lower axis 61. In the illustrated arrangement, the front link components 63 are positioned inboard of the end brackets 50 of the upper segment 40 and inboard of the up flanges 56 of the lower segment 41, and also the rear links 43 are positioned outboard of the end brackets 50 and outboard of the up flanges 56. However, it is contemplated that these relative positions can be reversed, or that the link components can both be in outboard or inboard positions. It is further contemplated that the joints and pinch points can be covered by the back support 37 or by aesthetic covers, or the pinch points can be eliminated by design of the components 40-43.

Figure 2:
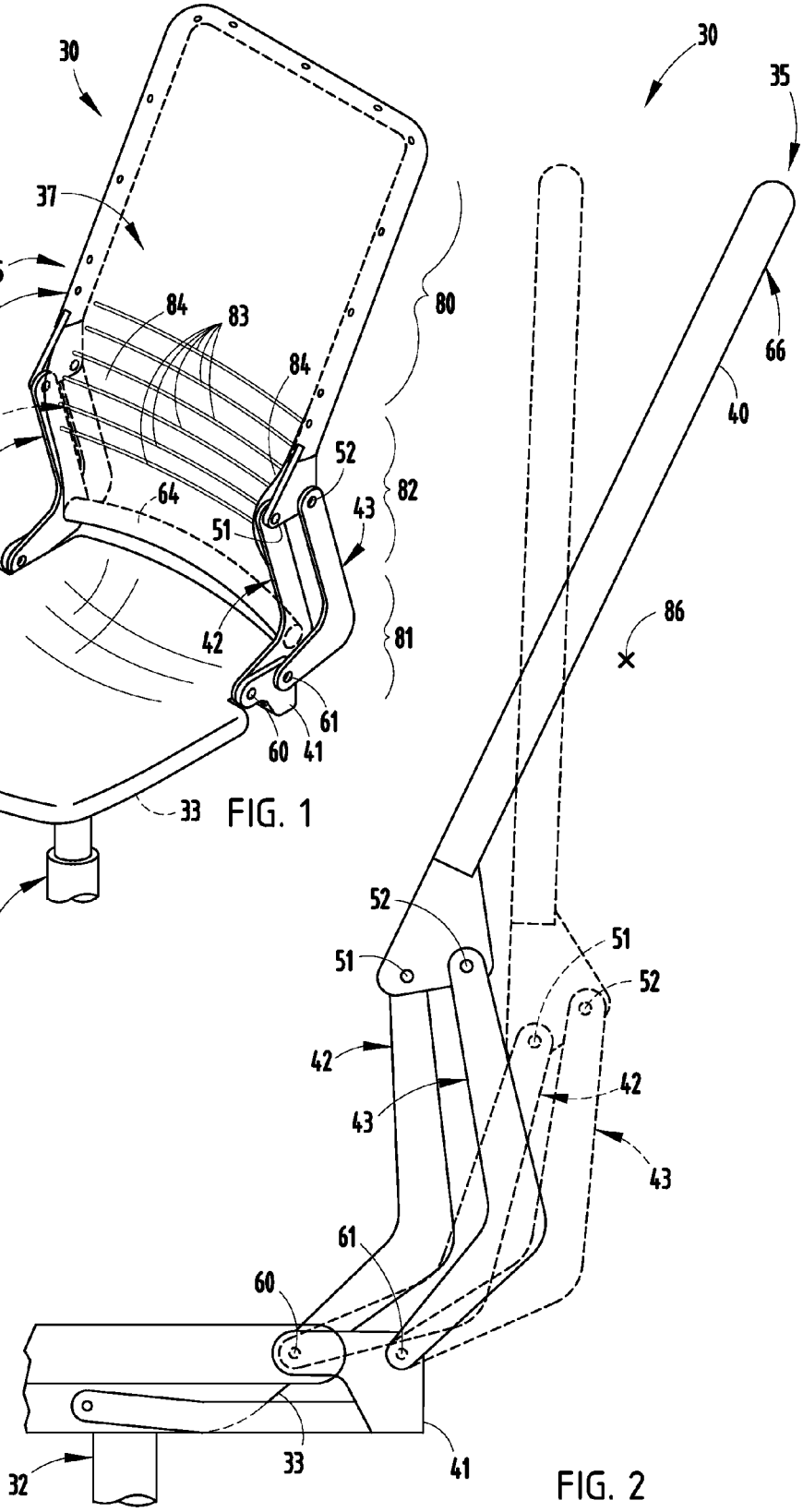
Figure 3:
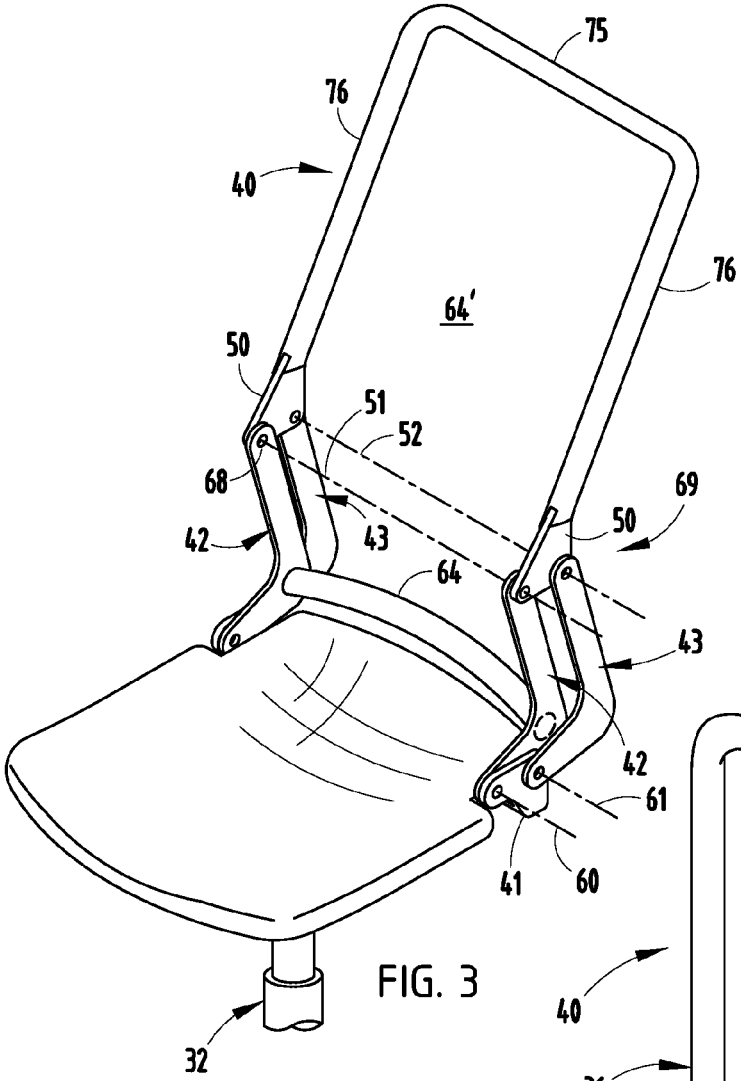
FIGS. 3-4 are perspective views of FIG. 1, FIG. 3 showing the lumbar joint of the back frame in a forward upright position and FIG. 4 showing it in a rearwardly flexed position.
Figure 4:
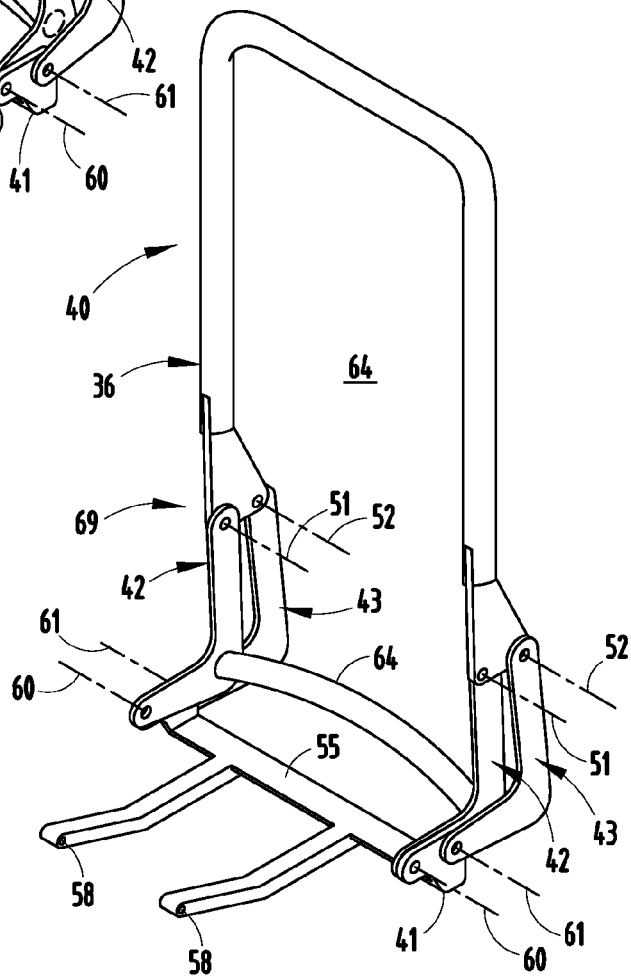

The back frame 36 (FIG. 3) defines an integral perimeter frame for supporting the back support 37. Specifically, the upper and lower segments 40 and 41 combine with the front link 42 to define an opening 64'. The upper segment 40 includes a top section 75, and opposing side sections 76 forming the U-shape. The link components 63 of the front link 42 extend vertically from the side sections 76, and further are pivoted to the brackets 50 of the upper segment 40 by the pivot pins 68 to define the lumbar joint 69. The cross tube 64 forms a bottom section of the perimeter frame. The back frame 36 can be flexed or articulated at the lumbar joint 69 (see FIG. 2) between a forward home position (FIG. 3) and a lumbar-rearwardly-flexed depressed position (FIG. 4).

The back support 37 (FIG. 1) is a sheet-like back shell made of polymeric material having a thoracic upper region 80, a pelvic lower region 81, and a flexible compliant lumbar region 82 with horizontal slots 83, which regions are not unlike that disclosed in Battey U.S. Pat. No. 5,871,258. The entire contents of Battey U.S. Pat. No. 5,871,258 are incorporated herein for their teachings of the operation of a flexible back shell and cooperating back frame. The lumbar region 82 includes vertical edge straps 84 that extend across the lumbar region 82. Preferably, the straps 84 are positioned relatively close to or in alignment with the axis of rotation of the lumbar joint 69, so that the lumbar region 82 flexes with articulation of the back frame 37 about lumbar joint 69 during flexure without biasing the thoracic and pelvic regions 80 and 81 vertically (compare FIGS. 3 and 4). To the extent that there is vertical stretching or expansion during articulation and flexure of the back frame 36 in the lumbar region 82, the lumbar region 82 of the back support 37 is made to stretch and expand (or shrink). This can be accomplished by additional slits in the lumbar region 82 and/or by the type of attachment used to attach the back support 37 to the back frame 36, and by other means known in the art of seating to accommodate shearing movement of structure and cover components.

The upper and lower segments 40 and 41 (FIG. 2) and the links 42 and 43 form an integrated four-bar-linkage arrangement. The upper pivot axes 51 and 52 are closer together (such as about 1½ inches apart) and the lower pivot axes 60 and 61 are farther apart (such as about 2 inches apart). Also, the vertical spacing between the axes 51 and 60, and also between 52 and 61 are about equal (such as about 6 to 8 inches). Since the links are relatively rigid, a lower portion of the upper segment 40 undergoes a well defined rotation and translation movement upon flexure at the lumbar joint 69. In turn, the position (rotational and translational) of the upper segment 40 is well controlled at all positions of back flexure. The result is that the back 35, especially in the lumbar region 82 but also in the thoracic region 80, mimics back flexure of a human being, allowing optimal back support for a seated user's upper torso. Restated, the back 35 maintains a human-torso-supporting shape that in all positions mates very well with and comfortably supports a seated user, ergonomically and compliantly. At the same time, it is noted that the back frame 36 is within the envelope of the back support 37 and does not need to be spaced rearwardly from the back support 37. For this reason, design of the back 35 is simplified, and design options are greatly increased. For example, it is contemplated that the present design will allow a back having a relatively thin profile (such as about 2 inches total thickness), and also the present design will not require a separately visible back frame. Notably, the back frame 36 defines a virtual pivot point 86 rearward of the upper segment 40 at a location a few inches above the lumbar joint 69, in a location similar to the upper pivot shown in the Battey '258 patent . . . but without the need for the back frame to have structure that extends to that position. Any portion of the back frame 36 that extends above the virtual pivot 86 moves forward upon rearward flexure of the back frame 36 at the lumbar joint 69. It is noted that the virtual pivot (86) can be located at different locations, especially at a higher location. This higher pivot location would require a higher lumbar energy spring rate and a lower back recline energy in order for the chair to give the seated user a similar support and feel.

An important feature of the present invention is that the relative location of the axes 51, 52, 60, and 61 can be located by design to achieve very specific flexure of the back frame 36, and hence provide a very specific shape change to the front surface of the back 35 during lumbar flexure of a seated user. It is conceivable that a second (or more) four-bar-linkage could be "stacked" on the first four-bar-linkage to achieve even greater control over the shape change. However, testing has shown excellent results with the illustrated single four-bar-linkage arrangement.

It is noted that the control 33 incorporates a biasing mechanism (such as one or more springs) for biasing the legs 57 upwardly and in turn biasing the entire back 35 toward an upright position. Such spring mechanisms are known and do not need to be described herein for an understanding of the present invention. The lumbar-biasing spring mechanisms discussed below are for biasing the lumbar joint 69 forwardly so that the back frame 36 defines a more forwardly-protruding convex shape. This forward position is referred to as a home position or forward protruding position. As a seated user presses rearwardly in the lumbar region, the lumbar joint 69 flexes rearwardly, and the lumbar-biasing spring mechanism provides resistance to rearward flexure, such that good lumbar support is provided to the seated user.

Figure 5:
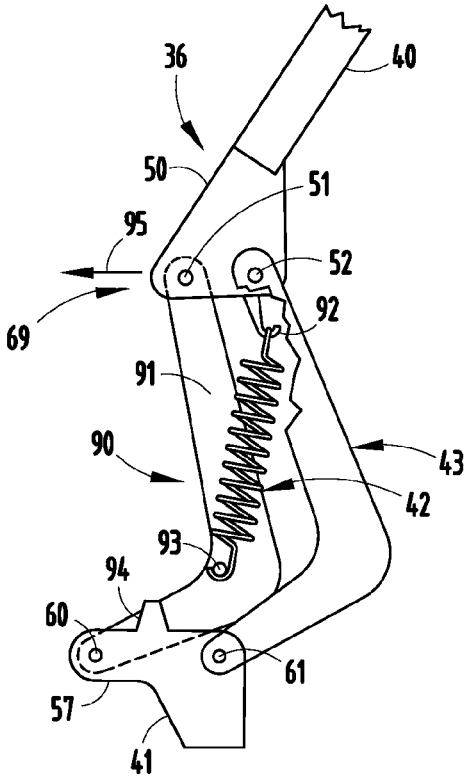
FIGS. 5-7 are fragmentary side views showing different energy mechanisms on the articulating back frame.

Energy can be incorporated into the present back design by different means. The lumbar biasing mechanism 90 (FIG. 5) includes an extensible coil spring 91 attached at a top end to a hook 92 on one (or both) of the end brackets 50 and also attached at a lower point 93 on the link component 63 of the front link 42. The illustrated hook 92 is positioned rearward of the upper front axis 51 such that the arrangement formed by upper front axis 51, the upper rear axis 52, the hook 92 and the lower point 93 causes the spring 91 to generate a force on the upper segment 40 (or on one or both of the links 42 and 43) biasing the lumbar joint 69 forwardly (i.e., biasing a top of the four-bar-linkage forwardly). A forward stop 94 is formed on the linkage arrangement, such as on the lower segment 41 at a location that will limit forward rotation of the front link 42. The stop 94 sets the home position and sets the forward articulation of the back frame 36. A similar stop can be formed to limit rearward flexure of the back frame 36.

It is contemplated that the hook 92 can be mounted for adjusting movement on the end bracket 50. For example, it is contemplated that the hook 92 could include a follower that slidably engages a horizontal fore/aft track on the end bracket 50. Alternatively, the hook 92 could rotate on a pivot pin on the end bracket 50. Adjustment could be driven by different means, such as by a threaded shaft engaging the follower and rotatably supported on the end bracket 50 so that, upon rotation, the hook 92 is moved in a fore/aft direction. By this mechanism, torque arm defined by the end bracket 50 (and hence the torsional force applied to the end bracket 50) changes during adjustment. Thus, different levels of lumbar biasing force 95 are provided. It is also contemplated that two springs 91 could be used, one on each side, with only being adjustably supported. However, where the back frame 36 is sufficiently rigid, a single spring 91 works well.

Figure 6:
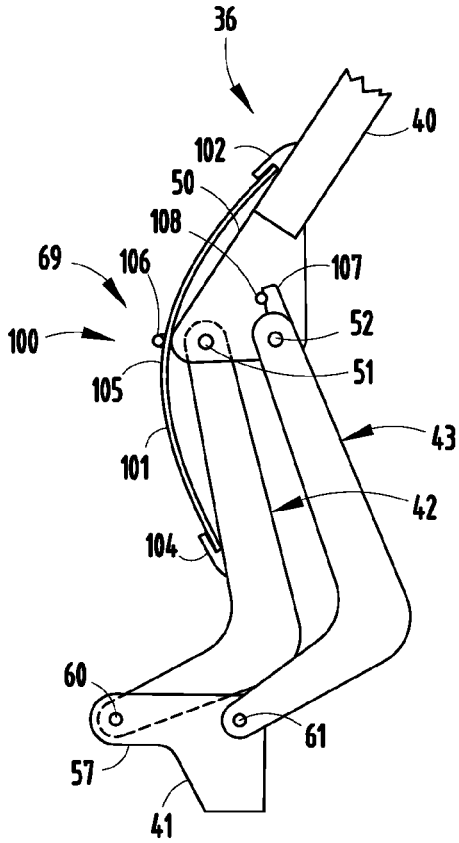

An alternative biasing mechanism 100 (FIG. 6) includes one or more leaf springs 101 attached at a top to a flange 102 on the upper segment 40 of the back frame 36, and attached at a bottom to a flange 104 on the front link 42. The leaf spring(s) 101 include a mid-portion 105 that extends across the lumbar joint 69 of the back frame 36. The mid-portion 105 is attached to the lumbar joint 69 by a retainer 106. The leaf spring(s) 101 are preformed to supply a desired level of forward bias to the lumbar joint 69. In the arrangement of FIG. 6, a forward stop 107 comprises a flange that extends upwardly from the rear link(s) 43 and that is configured to abuttingly engage a pin 108 on the end bracket 50 of the upper segment 40. It is contemplated that spring tension adjustment can be provided by adjusting the location and relative (forward/rearward) position of support for ends of the leaf spring(s) 101.

Figure 7:
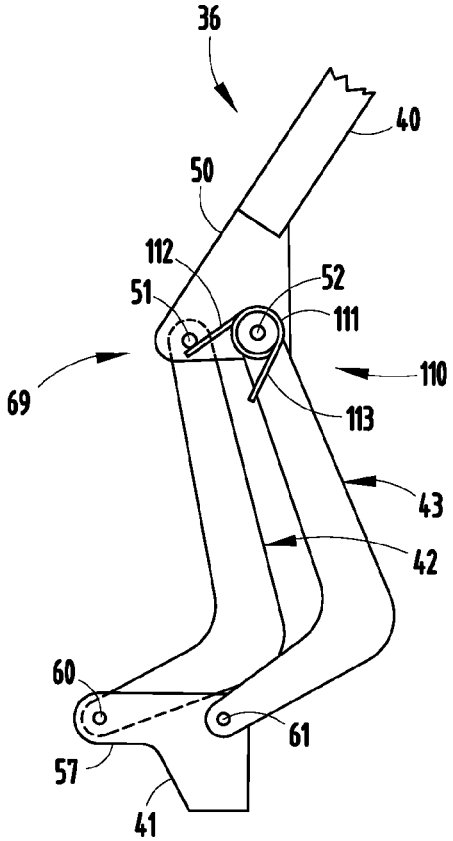

A second alternative biasing mechanism 110 (FIG. 7) includes one (or more) torsion springs 111 positioned at one of the pivot axes 51, 52, 60, and/or 61. The illustrated spring 111 includes a coil positioned at pivot axes 52, and includes a first leg 112 engaging the end bracket 50 at a forward location and a second leg 113 engaging the rear link 43. The spring 111 is configured to bias the end bracket 50 rotationally in a manner biasing the lumbar joint 69 forwardly. It is contemplated that adjustment could be accomplished by any mechanism that adjusts relative position of the spring legs 112 and 113, such as a sliding wedge on the end bracket 50 or one the rear link 43.

A variety of different embodiments and modifications are described hereafter. Identical numbers are used for components and features that are identical or similar to the previously described components and features, but with the addition of a letter such as the letter "A", "B", "C" and the like. This is done to reduce redundant discussion and not for another purpose.

Figure 8:
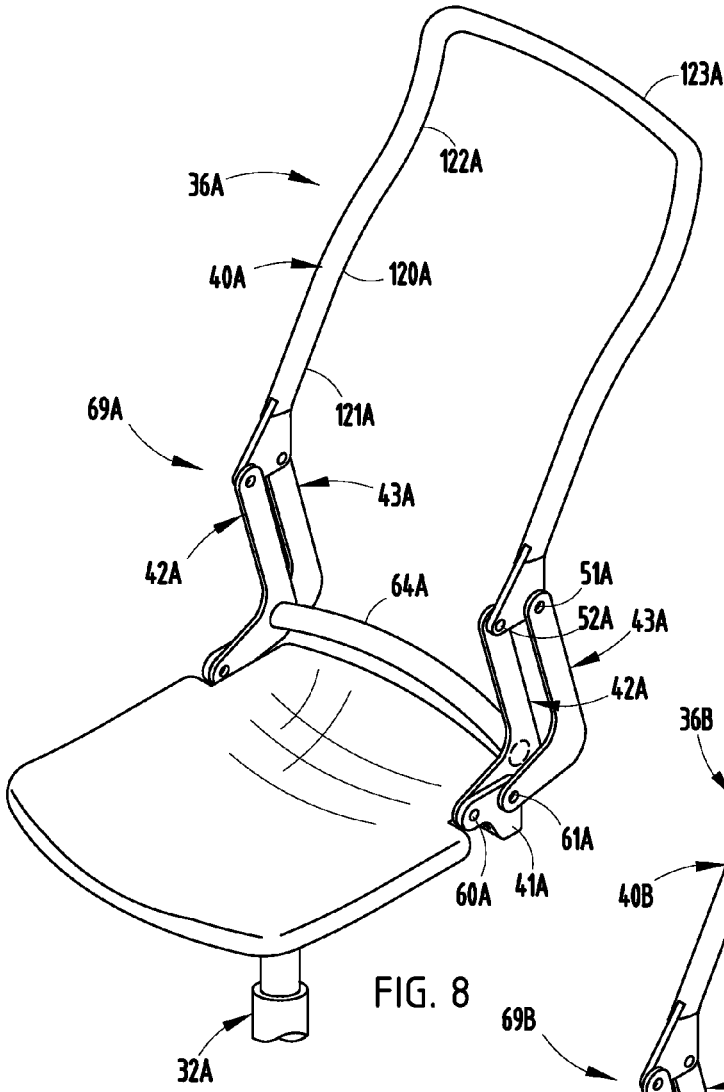
FIGS. 8-9 are perspective views showing modified back frames.
Figure 9:
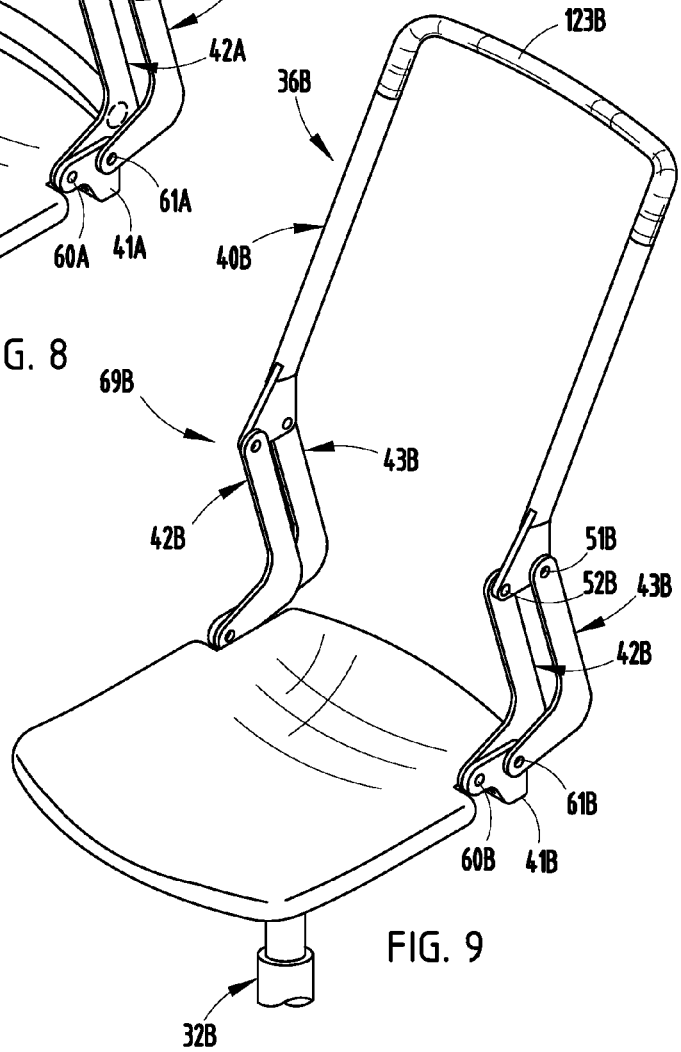

FIGS. 8-9 illustrate variations to the back frame accommodated by the present design. In the illustrated back frame 36A (FIG. 8), the U-shaped bent tube of the upper segment 40A includes side tube portions 120A that are bent to a preferred curvilinear shape, including a forwardly curved lower part 121A that leads down to the lumbar joint 69A. Also, the side tube portions 120A include an extended upper part 122A that is slightly forwardly bent, thus creating a slight pocket for receiving and supporting a seated user's head and shoulders. The upper segment 40A also includes a top cross tube portion 123A that bends rearwardly to define a forwardly-facing concave shape as it extends across between the side tube portions 120A. The cross bar 55A is bent rearwardly in a similar manner, though to a slightly greater extent. By this arrangement, when the back support (37) is attached to the segments 40A-42A of the back frame 36A with the back support (37) tensioned between the top cross tube portion 123A and the bottom cross bar 55A, a multi-curved shape is formed that is not unlike a PRINGLES® "potato chip" shape.

Figure 17:
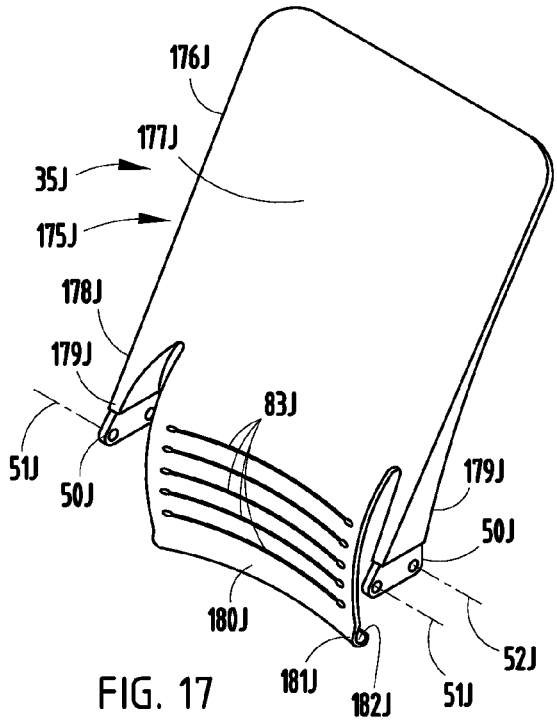
FIG. 17 is a perspective view showing a component integrating an upper segment of the back frame with the back support.

The back frame 36B (FIG. 9) includes a semi-flexible top cross tube portion 123B and has the bottom cross bar (55) eliminated. This arrangement makes the back frame 36B torsionally more flexible, such as to better accommodate and ergonomically support a twisting motion and/or a rearwardly leaning side motion of a seated user. It is contemplated that the top cross tube portion 123B could be made in different ways. For example, it could be made from tubular metal, a metal stamping, a plastic component, or by any structural material having sufficient structure and durability for the intended purpose. It is contemplated that the structure of the back frame 36B and back support (37) can be modified to provide the structure and yet compliance and durability desired. For example, additional structural support can be achieved by the way that the lumbar joint 69B is formed, and also by modifying the structure forming any and all of the back frame 36B (including components 40B-43B) and/or the structure of the back support (37), and/or the structure provided by virtue of the assembly of the back support (37) to the back frame 36B. Also, stability of the links 42B and 43B can be modified and improved if desired, such as by providing sliding (scissor-like) inter-engagement. Further, it is contemplated that the upper segment of the back frame and the back support can be integrally formed together, such as is illustrated in FIG. 17 described below.

FIGS. 10-16 illustrate the numerous variations to the back support accommodated by the present design. A variety of covering constructions (including upholstered or not, and including a cushion or not) are generally known in the art. An exemplary covering construction is disclosed for example in Battey '258, and the teachings related to the upholstery subassembly are incorporated herein from Battey '258.

Figure 10:
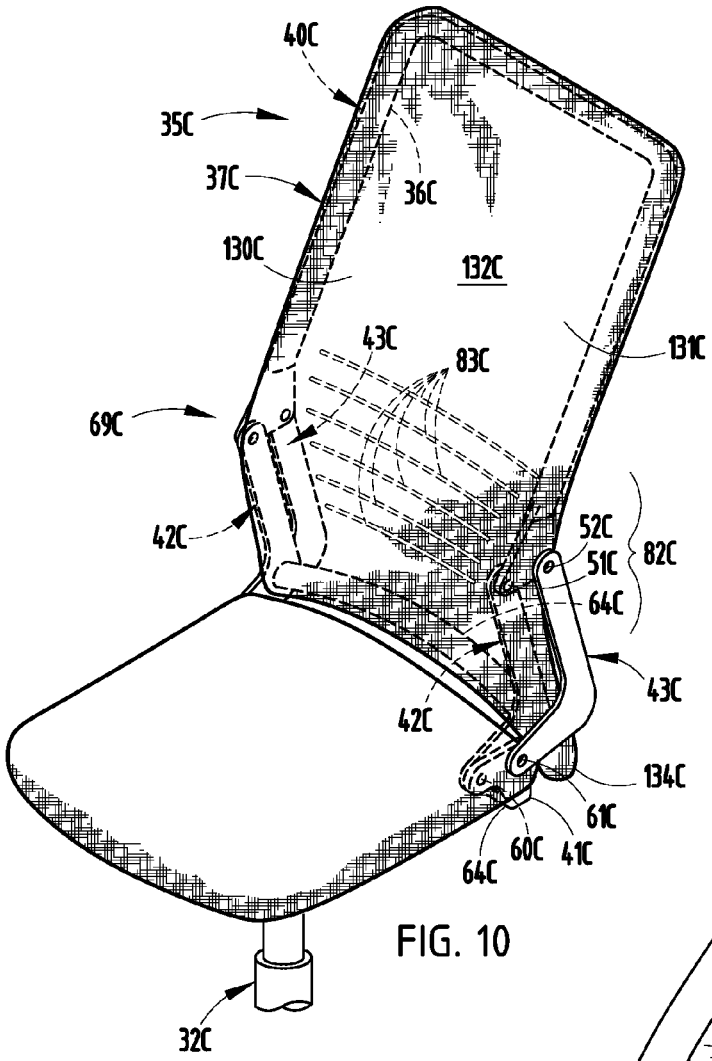
FIGS. 10-16 are perspective views showing modified back supports on the back frames, including FIGS. 11A-11D which show cross-sectional contours in the back support of FIG. 11.

The illustrated back support 37C (FIG. 10) includes a covering subassembly 130C that includes a sock-like upholstery covering 131C with an internal cushion 132C. A sheet-like panel-shaped cushion stiffener attached to a back surface of the internal cushion, such as by adhesion or staples, to stabilize the cushion when the sock-like upholstery covering 131C is being pulled downwardly onto the upper segment 40C of the back frame 36C. The lower edge of the upholstery covering 131C includes a panel portion 134C attached to the cross bar 55C. It is contemplated that the subassembly 130C may incorporate a stiff panel portion 134C that extends below the cross bar 55C. As illustrated, the stiff panel portion 134C extends below a top surface of a rear edge of the seat 34C to a location shielding and hiding from view the cross tube 64C. It is noted that the lumbar region of the covering subassembly 130C passes over the lumbar joint 69C of the back frame 36C. The covering subassembly 130C is made stretchable in at least a vertical direction. This can be done, for example, by providing the horizontal slots 83C in the lumbar region 82C of a plastic back shell (see FIG. 1), and/or by providing a stretchable cushion stiffener and fabric portion in the lumbar region 82C of the upholstery covering 131C (FIG. 10). The covering subassembly 130C would be stretched and tensioned when the lumbar region is moved from the forwardly-biased home position (FIG. 3) toward the rearwardly-flexed position (FIG. 4). The stretching of the lumbar region occurs due to the downward movement of the cross bar 64C during rearward movement of the lumbar joint 69C, even thought the center vertical shape changes from a forwardly curved convex shape toward a more planar shape. The stretched material takes up the reduced vertical distance when in the forwardly-biased home position.

Figure 4A:
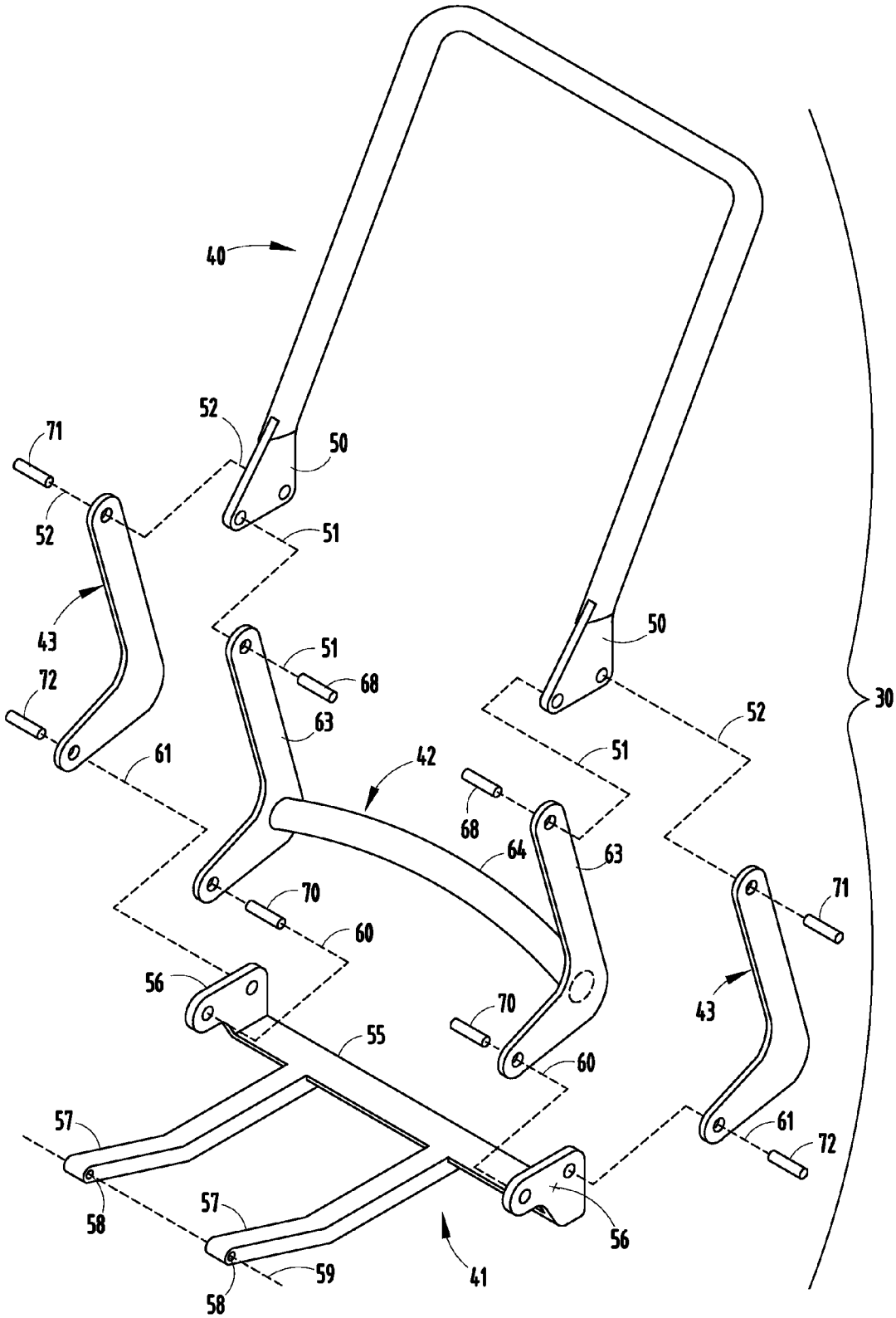
FIG. 4A is an exploded perspective view of FIG. 4.
Figure 11A:
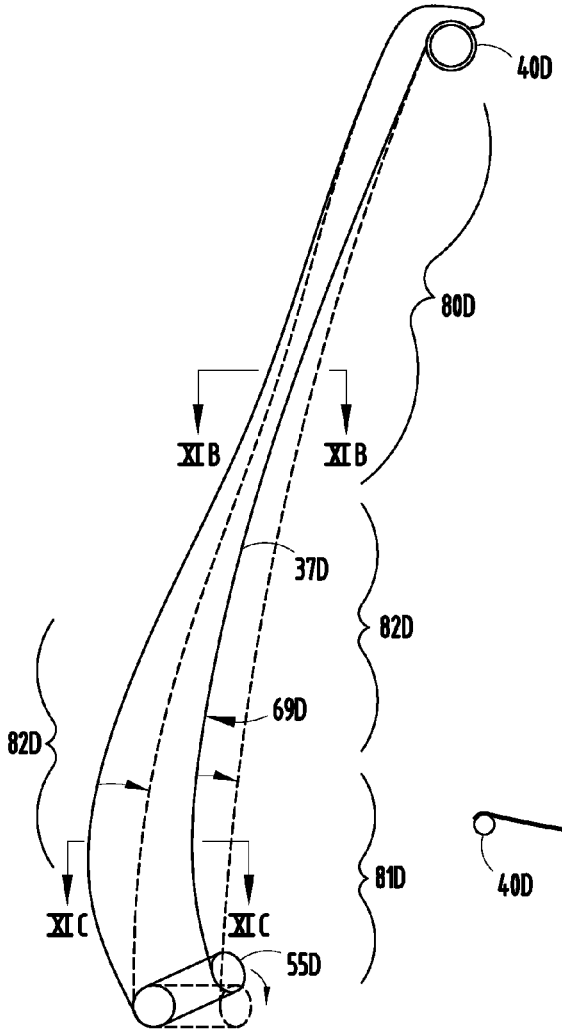

Back 35D (FIG. 11) includes an articulating tubular perimeter frame 36D having components 40D-43D similar to back 35 (FIG. 4A). The back support 37D (FIG. 11) is a structural fabric (sometimes called a "performance fabric") or alternatively is a thin sheet of plastic forming a flexible shell. As illustrated by the vertical cross section of FIG. 11A (which is taken through a center of the back 35D), a vertical center line on the front surface of the back support 37D forms a forwardly curved shape including a forwardly protruding convex lumbar region 82D. As illustrated by the higher horizontal cross section of FIG. 11B and the lower horizontal cross section of FIG. 11C, the back support 37D defines a rearwardly-curved forwardly facing concave shape, that changes in depth from shallow near its top (FIG. 11B) to deeper near the lumbar joint 69D (FIG. 11C) and then again to shallower near the cross bar 55D. The back support 37D is relatively unstretchable and non-elastic in the horizontal direction, but is deformable in a fore-aft direction perpendicular to the surface of the back support 37D. This allows non-uniform support for a seated user, as illustrated by FIG. 11D which shows an offset flexure of the illustrated horizontal section at location 136D. For example, this would occur if a seated user leans rearwardly and to the left, such as when reaching for an object while in the upright or reclined positions of the back 35D. This combination of a "sling-type" approach for back support, where a lumbar region and/or thoracic region is horizontally unstretchable and yet vertically stretchable and where it is combined with an upper frame segment 40D that permits some twist and torsionally-compliant support to a seated user, is considered by the present inventors to provide a very unique and ergonomic back supporting arrangement. The comfort and compliant/ergonomic nature of this back support system is believed to provide surprising and unexpected results in terms of excellent ergonomic back support to a seated user, allowing the seated user to move and adjust their torso support in a manner pumping nutrients to the seated user's back even after sitting in the seating unit for an extended period of time. Also, the arrangement allows air flow to a seated user's back, which can increase comfort by allowing sweat and heat to pass from the seated user through the back construction.

It is noted that the thoracic upper region 80D (FIG. 11A) has less curvature than the lumbar region 82D, and as illustrated is relatively flat. It is contemplated that the upper region 80D will be vertically unstretchable or at least will have a lower vertical stretchability than in the lumbar region 82D. Contrastingly, in a horizontal/lateral direction, it is contemplated that some low level of stretchability may be desired in the thoracic upper region 80D. Where the upper segment 40D of the back frame 36D includes some degree of lateral flexibility, the amount of stretchability and elasticity of the back support 37D can be reduced. For example, reference is made to the articulating back frame 36B (FIG. 9) which has a flexible top tube portion 123B permitting the side frame portions to flex inwardly toward each other a small amount in a controlled manner.

The back 35E (FIG. 12) includes an articulating back frame 36E similar to the back frame 36. The back support 37E includes a plurality of horizontal straps 140E and a vertical strap 141E. It is noted that the illustrated straps 140E extend horizontally, but it is contemplated that the straps 140E could extend diagonally, or at an angle to horizontal, between the side edges of the back frame 36E and accomplish a similar sling-like support function. The straps 140E and 141E have their ends attached to the back frame components 40E-43E by a convenient method, such as by wrapping ends of the straps 140E and 141E onto the respective parts of the components 40E-43E and securing the ends in place with a screw or other secure retainer. The horizontal straps 140E are basically unstretchable and non-elastic. It is specifically contemplated that the horizontal straps 140E can have different degrees of stretchability and/or elasticity. For example, it is contemplated that the lower horizontal straps 140E will have less (or zero) stretchability, while the upper straps 140E in the thoracic upper region 80E will have some limited stretchability. Also, a length of the straps 140E can be varied. For example, it is contemplated that the lower horizontal straps 140E will have more length and be looser than the upper horizontal straps 140E. This allows the lower straps 140E to be drawn rearwardly by the vertical strap 141E into the "potato chip shape" described below. Further, the horizontal straps 140E can be made to have different lengths and to define curvilinear shapes with gradually decreasing depths as one moves from the lumbar region upwardly to the thoracic region. The back support 37E comprising straps 140E and 141E is referred to as a "smart suspension" or an "intelligent suspension" because it provides different responses in different areas, with particular areas and/or particular straps providing back support to a seated user that is tailored to specific needs. Also, the back support 37E can be adapted to provide specific response to shear stress as a seated user flexes their lumbar and/or as the seated user reclines. Shear stress is caused by forces that occur parallel a front surface of the back support 37E, such as when the back support moves in a direction during recline that is different than the seated user being supported. A limited amount of shear stress can be acceptable, because it holds the user in the seating unit, and further gives the seated user a sense of stability. By controlling the inter-engagement of the straps 140E and 141E at locations of overlap, such as by permitting a small amount of slippage or by providing some stretch in the vertical strap 141E while limiting (or eliminating) stretch or expansion in straps 140E, the support received by a seated user from the back support 37E can be very well controlled at a local level, and even customized for particular users. It is noted that the present back support 37E can be covered by a cushion and upholstery assembly, which would allow additional control of and allow further distribution of shear stress.

Figure 11B:
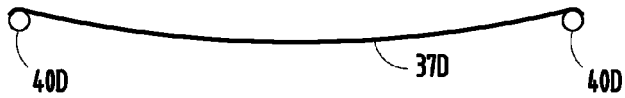
Figure 11C:
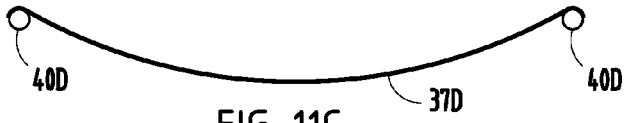
Figure 11D:
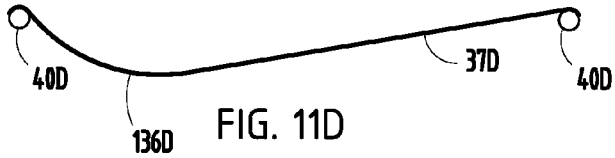

Due to vertical tension of the vertical strap 141E and the different lengths of the horizontal straps 140E, a "potato chip" shape occurs in the lumbar region 82E (i.e., the forwardly protruding convex shape of the lumbar region 82E as shown in FIG. 11B, and the rearwardly-curved, forwardly-facing, concave shape of the lumbar region 82E as shown in FIG. 11C) which is formed by the straps 140E and 141E. As illustrated, the vertical strap 141E is in front of the straps 140E such that it abuttingly engages and biases a center section of the horizontal straps 140E rearwardly. The vertical strap 141E has sufficient width to distribute rearward pressure against it from a seated user. Alternatively, the straps 140E and 141E could be covered with a covering subassembly not unlike the covering subassembly 130C described above. Alternatively, the straps 140E and 141E could be interwoven and/or otherwise attached or coupled together at points of intersection to provide the desired level of interaction. It is noted that the horizontal straps 140E have different lengths and are attached to define "slings" of different depths and lengths as desired to control a shape of the front surface on the back support 37E, especially at inboard locations through the lumbar and thoracic regions. The horizontal straps 140E can extend horizontally across the back frame or at an angle to horizontally, and can extend parallel and with uniform spacing and be of similar widths, . . . or can extend non-parallel and/or with non-uniform spacing and/or with unequal widths.

Back 35F (FIG. 13) includes a one-piece customized fabric covering 130F attached to the back frame 36F. The back frame 36F is similar to the back frame 36. The covering 130F is made from a fabric having non-uniform elastic properties formed inherently within the fabric itself. This can be achieved by the particular weave that is used in various locations on the covering 130F, and/or by the particular threads used at different locations on the fabric covering. Alternatively, the different stretch and/or elastic rates can be achieved by stitching on the covering. For example, starting with a relatively flexible fabric, a line of stitching 149F could be sewn into the fabric horizontally in the lumbar region 82F and to a lesser extent horizontally in the thoracic region 80F to control stretch and provide the desired level of expandability. Alternatively, the base fabric could be performance fabric having non-tear properties. Expandability could be achieved by slits of various lengths and predetermined patterns to allow the desired expansion ("stretch") in localized areas.

Back 35G (FIG. 14) illustrates yet another alternative. In back 35G, the covering 130G is an assembly of horizontal strips 150G-155G sewn to the bottom of an upper panel 156G, and a vertical strip 157G sewn across a vertical slot in a center of the upper panel 156G. Each of the strips and panels 150G-157G are selected to achieve a particular force deflection curve in their respective locations. In particular, a low (or zero) stretch rate is achieved in the lumbar region as shown by arrow 158G, a relatively higher stretch rate is achieved in the lumbar region as shown by arrow 159G, an intermediate level of stretch rate is achieve in the thoracic region as shown by arrow 160G, and a low (or zero) stretch rate is achieved in the lumbar region as shown by arrow 161G.

Back 35H (FIG. 15) illustrates that the back support 37H can be made from a solid sheet of plastic. The back frame 36H is similar to back frame 36 disclosed above. Edges of the sheet of back support 37H are wrapped around the associated back frame components 40H-43H and secured thereto, such as by rivets or screws or other fastening means. The back support 37H includes horizontal slits 165H that extend inward from sides of the back support 37H. The slits 165H are different lengths. For example, as illustrated, the slits 165H are alternatively long and then short. This results in a center strip that has some degree of vertical expansion along arrow 166H in the thoracic region 80H. Also, the slots 83H in the lumbar region 82H are more closely spaced, extend substantially across a center of the back support 37H, and are relatively continuous. Thus, the lumbar region 82H is vertically very flexible, and yet is horizontally as stiff and unstretchable as the sheet material of back support 37H itself. It will be understood by those skilled in the art that a variety of different slit and slot patterns are possible in order to achieve localized control over stretching and expansion of the back support 37H.

In back 35I (FIG. 16), the back support 37I is made of a sheet of plastic material and is attached to the back frame 36I by screws or the like. It is contemplated that the back support 37I could have molded-in snap-attachment features that interlockingly engage the respective shapes of the back frame components 40I-43I. The back support 37I includes marginal panel-like perimeter sections 170I that extend outboard of the upper segment 40I of the back frame 36I. This allows for a larger back supported area. Alternatively, the back frame 36I can be reduced in size . . . in which case the perimeter sections 170I would extend to define a perimeter shape that is similar in size to the back support 37.

Back 35J (FIG. 17) includes an integrated component 175J that forms both the upper back segment portion 176J (i.e. similar to upper segment 40) and a back support portion 177J (i.e., similar to back covering 37). The component 175J is a one-piece molding that potentially includes an insert-molded or raised-surface stiffening rib 178J that extends around a perimeter of the component 175J. End brackets 50J are insert-molded or attached to the down arms 179J. The end brackets 50J include holes that define the pivot axes 51J and 52J. The horizontal slots 83J are integrally formed into the body 180J of the back support portion 177J. Also, a lower flange 181J is formed along a lower part of the component 175J and defines a recess 182J for matingly engaging the cross bar 55J. The flange 181J can be configured for snap attachment to the cross bar 55B, or alternatively, screws or other fastening means can be used.

Figure 18:
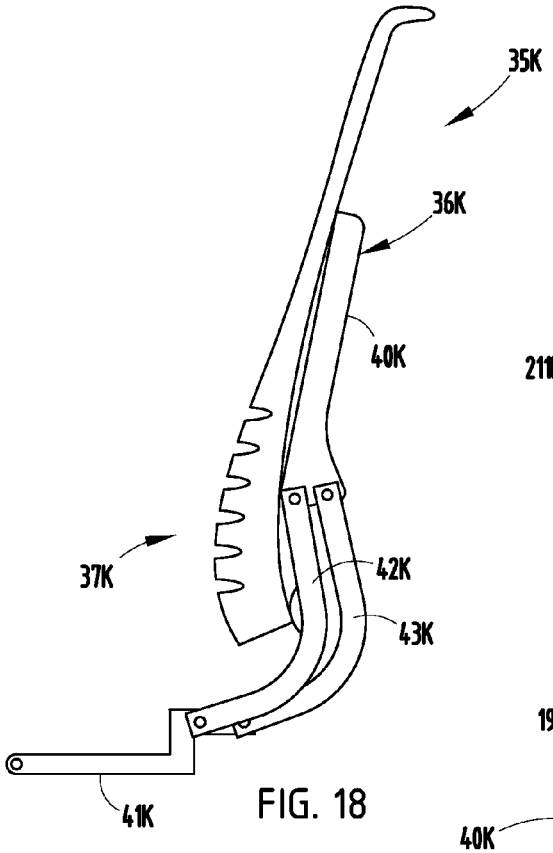
FIG. 18 is a side view of another modified seating unit, including a modified back frame and modified back support.
Figure 20:
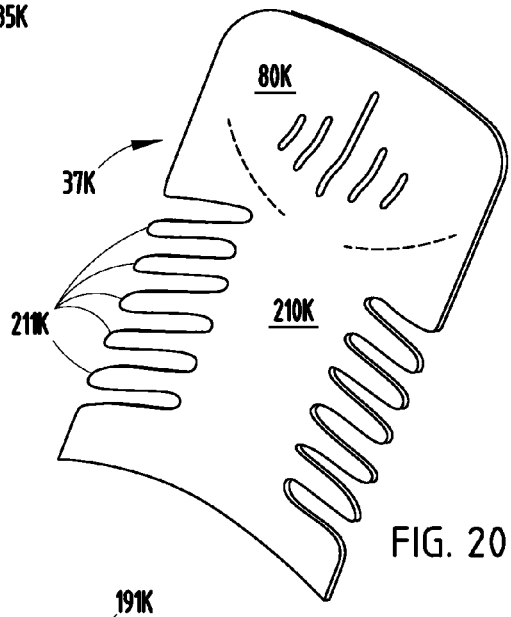
FIG. 20 is a perspective view of the back support of FIG. 18.
Figure 19:
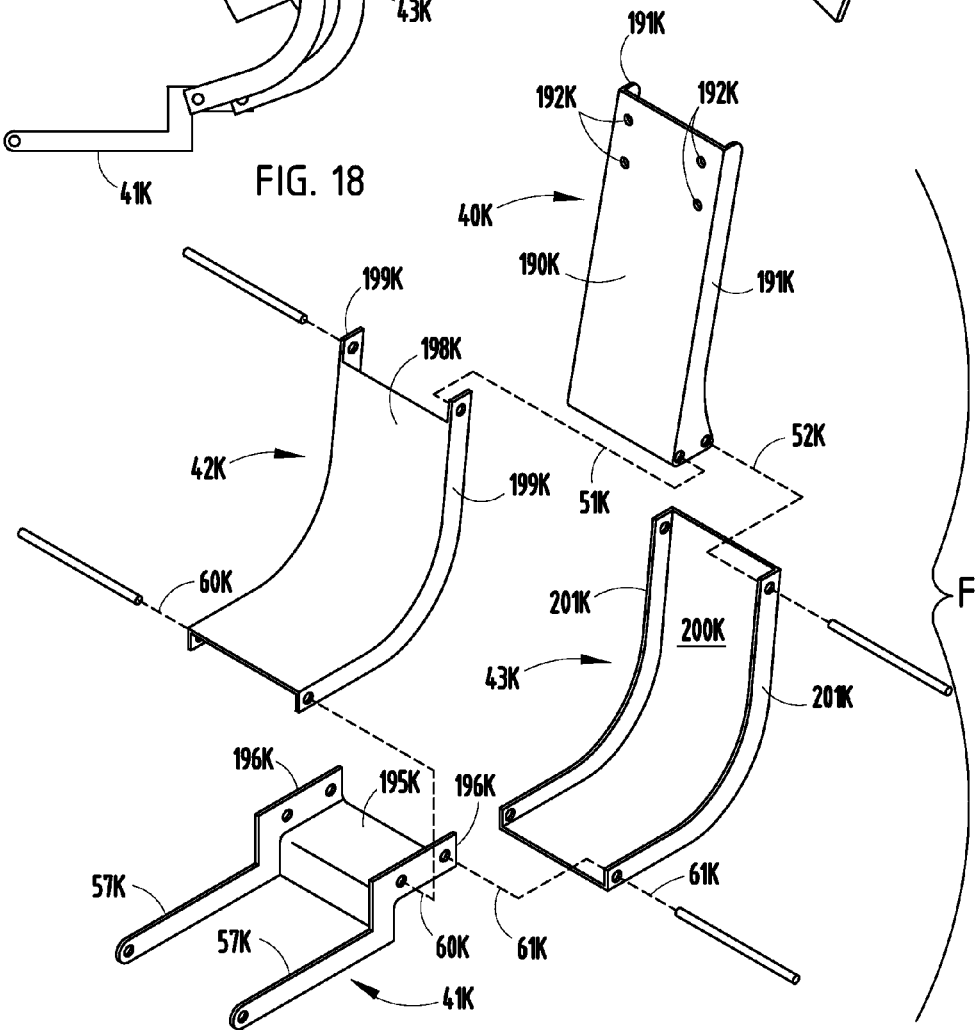
FIG. 19 is an exploded perspective view of the articulating back frame of FIG. 18.

Further modifications to the back frame are also contemplated. The back 35K (FIGS. 18-20) includes an articulating back frame 36K that includes components 40K-43K and further includes a back support 37K that includes a flexible back shell of dense structural plastic having the appearance of a human spine and ribs. The upper segment 40K includes a stamped upright member having a front wall 190K, side flanges 191K and upper and lower walls and/or reinforcements as may be required for stiffness and structural integrity. Holes 192K are provided in the front wall 190K for attachment of the back support 37K to the upper segment 40K. The side flanges 191K include holes forming the pivot axes 51K and 52K. The lower segment 41K is formed by a single stamping that includes a transverse wall 195K, upwardly-extending side flanges 196K, and forwardly-extending legs 57K. The up flanges 196K include holes forming the axes 60K and 61K.

The front link 42K (FIG. 19) is stamped to form a curved center panel 198K and side flanges 199K that extend along and stiffen the panel 198K. Holes are formed in the side flanges 199K at the top to define the front upper axis 51K, and at the bottom to define the front lower axis 60K. The panel 198K and flanges 199K form a C-shaped cross section that faces rearwardly and that is relatively stable. In the side view, the front link 42K has an L-shaped appearance similar to link 42.

The rear link 43K has a shape similar to front link 42K, though its "L" shape is "reversed". Specifically, the rear link 43K is stamped to form a curved center panel 200K and side flanges 201K that extend along and stiffen the panel 200K. Holes are formed in the side flanges 201K at the top to define the rear upper axis 52K, and at the bottom to define the rear lower axis 61K. The panel 200K and flanges 201K form a C-shaped cross section that faces forwardly and is relatively stable. The shape of the links 42K and 43K allow the side flanges 199K and 201K to overlap and interfit, if desired. A total width of the links 42K and 43K is less than a total width of the back support 37K, such as about half or one third of the total chair width.

The back support 37K (FIG. 20) includes a solid panel-shaped top section 80K adapted to form good thoracic support. A center wall 210K having a width about equal to or slightly greater than the width of the links 42K/43K extend downwardly across the lumbar region 82K. Finger-like protrusions 211K extend outboard from the opposing edges of the center wall 210K. The illustrated finger-like protrusions 211K have free ends adapted to flex. It is contemplated that the ends could be interconnected for mutual interaction and support, such as by extending a perimeter wire or the like vertically between them. The back support 37K is attached to the upper segment 40K and front link 42K and also to the lower segment 41K as desired to provide a good stable feeling to a seated user.

MODIFICATION

Figure 21:
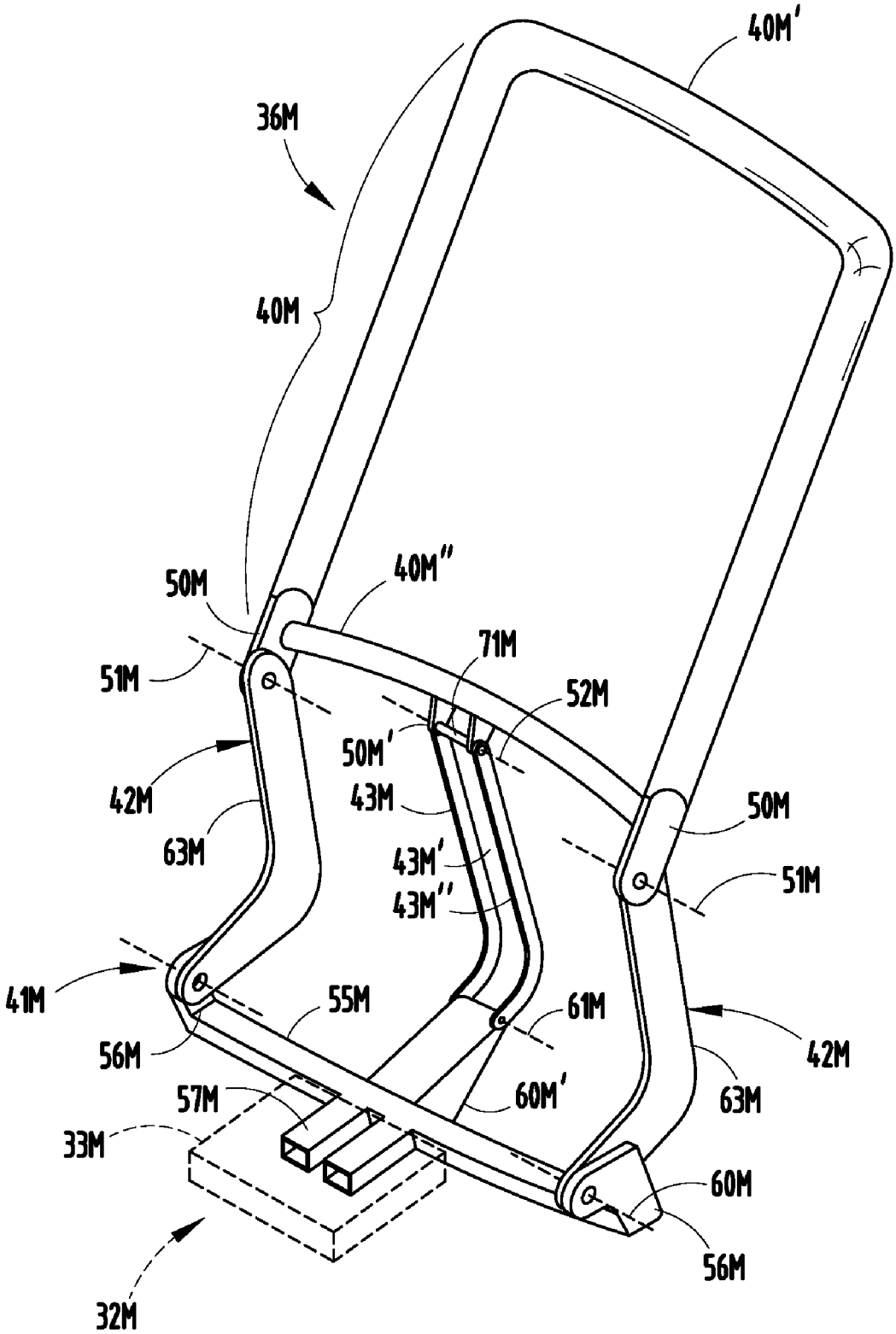
FIG. 21 is a perspective view of another modified back frame not totally dissimilar to the one shown in FIGS. 4 and 4A.
Figure 23:
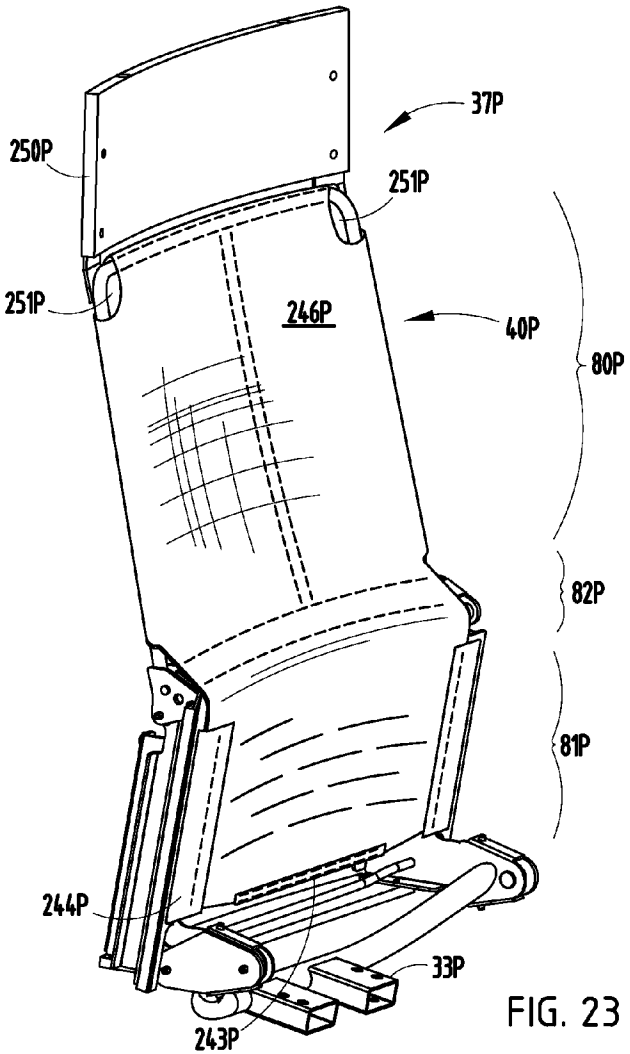
FIGS. 22-25 are perspective views of additional back coverings not totally dissimilar to the ones shown in FIGS. 1 and 12.

The articulating back frame 36M (FIG. 21) is not totally dissimilar to the back frame 36 (FIG. 1). The back frame 36M (FIG. 21) includes upper and lower segments 40M and 41M interconnected by a multi-link mechanism including links 42M and 43M. The upper segment 40M defines an inverted U-shape and includes an arcuately bent cross tube 40M' with pivot-defining brackets 50M at its lower ends and a centered (second) pivot-defining bracket 50M' welded to a center of the bent tube 40M'. The illustrated brackets 50M are stamped components that fit into slots in the ends of the segment 40M. A second cross tube 40M" extends between the brackets 50M. The brackets 50M each include holes defining an upper forward pivot axis 51M. The holes defining an upper rearward pivot axis 52M are located in the center bracket 50M'. The location of the axes 51M and 52M can be varied depending on the requirements of back flexure. The illustrated axes 51M and 52M are about 1½ inches apart. Advantageously, by the present design, the curvature of the bent cross tube 40M' (i.e., the curvature in a lumbar area of the back construction) substantially locates a distance between the axes 51M and 52M. This saves material, cost, and reduces complexity of components.

The lower segment 41M (FIG. 21) includes a cross bar 55M with up-formed flanges 56M at each end. An attachment leg 57M extends forwardly from a center of the cross bar 55M, the leg 57M extending a distance sufficient to connect to a control 33M. (For example, see the control shown in Heidmann U.S. Pat. No. 5,873,634, issued Feb. 23, 1999). The illustrated leg 57M is box shaped and configured to fit matably into a receiving throat in the control 33M. Notably, the present back 35M can also be used on a seating unit that does not provide any back recline. Controls for providing synchronous seat and back motion upon back recline are well known in the art, and a specific disclosure of such a control is not necessary for an understanding of the present inventive concepts. Nonetheless, it is contemplated that part of the present inventiveness is a combination of the present novel concepts with a seating unit having a synchrotilt control for its seat and back. The up flanges 56M include holes defining a lower forward pivot axis 60M. A center bracket 60M' extends rearwardly from a center of the cross bar 55M and defines a lower rearward axis 61M. The location of the axes 60M and 61M can be varied depending on the requirements of back flexure. The illustrated axes 60M and 61M are about 2 inches apart.

Front link 42M (FIG. 4A) includes right and left vertically-extending link components 63M. The illustrated link 42M does not include any cross tube (64) . . . though it is contemplated that it could if desired. The link components 63M are stamped parts having an L-shaped side profile that positions attachment to the mating brackets at top front axis 51M and at bottom front axis 61M in desired locations. It should be understood that differently shaped links can be used. For example, see link 43D which is linearly shaped (FIG. 11). Pivotal attachment is made by rivet-like connectors or pivot pins.

The rear link 43M (FIG. 21) is a single stamping including an L-shaped flat center band 43M' and upright flanged edges 43M" that rigidify the link 43M. Alternatively, the link 43M can include separate right and left components (links similar to the links 43 in FIG. 4A). The rear link(s) 43M (FIG. 21) is pivoted to the centered bracket 50M of the upper segment 40M by pivot pin 71M that extends along rear upper axis 52M, and are pivoted to the centered bracket 50M by pivot pin 72M that extends along rear lower axis 61M. It is contemplated that the joints and pinch points can be covered by the back support 37M or by aesthetic covers, or the pinch points can be eliminated by design of the components 40M-43M.

FIGS. 22-25 utilize a common back frame (i.e., similar to back frame 36M), but are covered by different back upholstery covers (also called "back support" herein). The back frame 36N (FIG. 22) includes upper and lower segments 40N and 41N, with the upper segments 40N defining a perimeter around an opening 64N'. The illustrated upper segment 40N includes a top bar section 75N, opposing side bar sections 76N, and a cross bar 40N'. The lower segment 41N includes a bottom cross bar 55N and up flanges 56N, and is joined to the upper segment 40N by front and rear links 42N and 43N. The back support 37N includes inwardly-facing C-shaped extrusions 240N-242N engaging the components 75N, 76N, and 76N (on the second side). The back support 37N further includes inwardly-facing C-shaped extrusions 243N-245N engaging the lower cross bar 55N, and front link side components 63N and 63N. A fabric or upholstery covering 246N is sewn onto the extrusions 240N-245N and includes an upper panel forming the thoracic upper region 80N, a lower panel forming the pelvic lower region 81N, and a flexible compliant lumbar region 82N. A preferred fabric is a three-dimensional fabric called "Technofabric" or Dimitrol™. Basically, it has front and rear surfaces formed by knit fabric connected by threads extending between the front and rear surfaces. As attached, it has basically a zero-stretch in a horizontal direction, and about a 4% vertical stretch. Vertical stretch is important for flexibility as the back frame 36N flexes in the lumbar region, so that the upholstery material can give as a front surface of the back frame 36N extends or contracts. Contrastingly, horizontal non-stretch is important so that a seated user receives the support desired. It is noted that the regions 80N-82N can be formed of a single continuous material or sheet, or can be formed from sections of sheets sewn together, the selected sections having desired directional elasticity and stretch rates. It is contemplated that vertical stretch rates can be improved by incorporating slits 248N into the lumbar or pelvic regions, such as slits 248N which are overlapping and extend horizontally.

It is contemplated that the back support 37N (FIG. 22) will include an outer covering, such as an upholstery sock pulled downwardly onto the upper segment 40N and pulled over the lower segment 41N. It can be secured in position by attachment of the lower edge of the upholstery sock either to itself (i.e. sewing the front panel to the back panel). Alternatively, it can be secured at the lower edge by securement to the lower cross bar 55N.

A headrest 250N (FIG. 22) is secured to its upper cross bar 75N. The headrest 250N includes upwardly-extending side brackets 252N and a panel 253N attached to the face of the brackets 252N. An upholstery sock (not shown) is pulled onto the headrest and suitably sewn and attached for aesthetics at a location above the back frame 36N. Alternatively, the upholstery sock is sufficiently long to completely cover the headrest as well as the back frame 36N.

Figure 22:
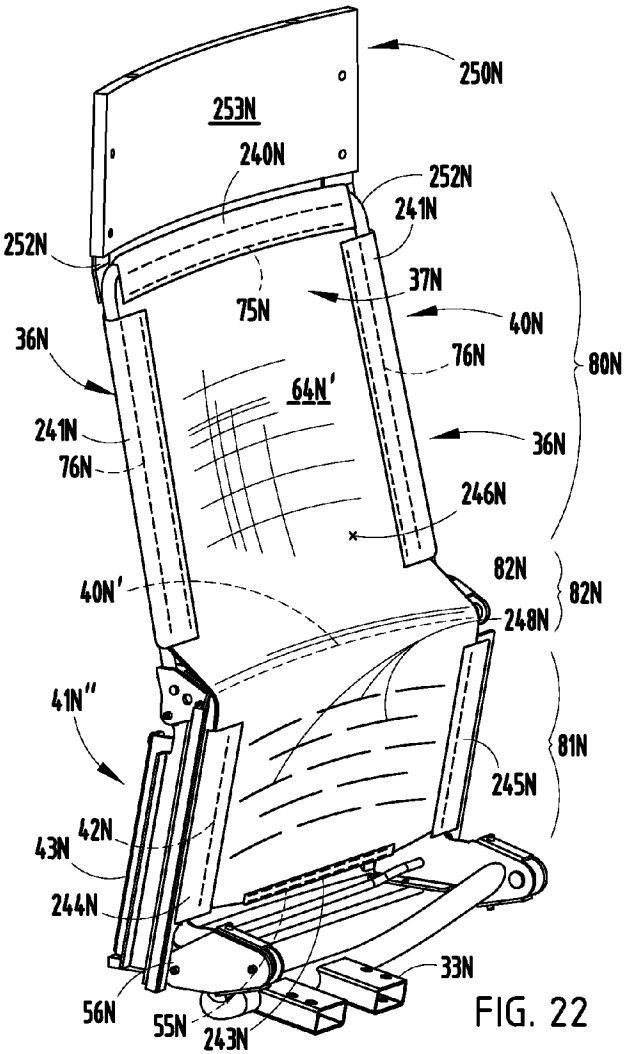
Figure 25:
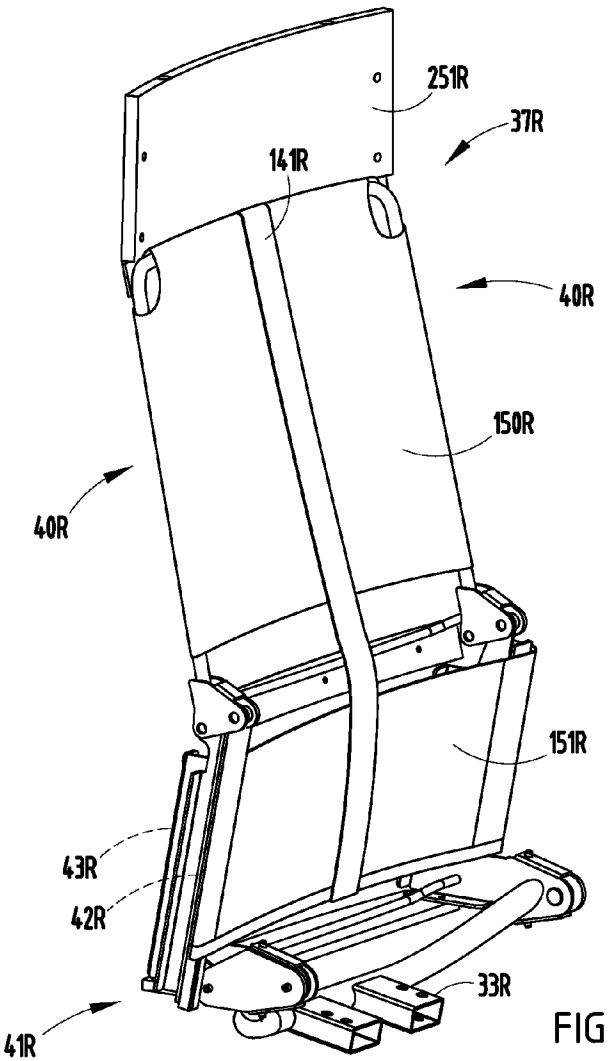
Figure 24:
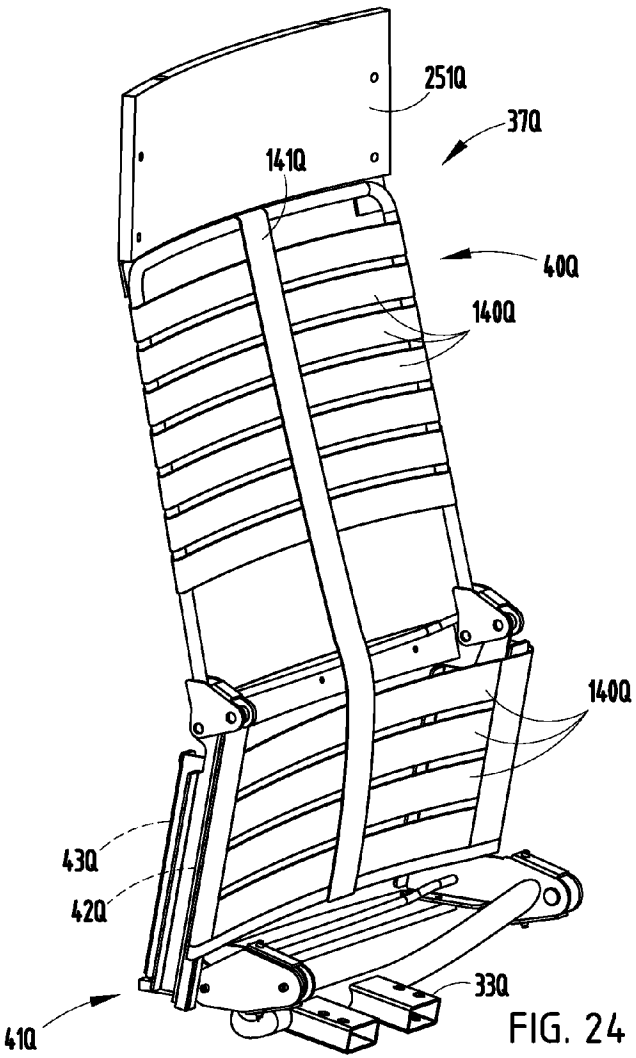

Back support 37P (FIG. 23) includes a pelvic region 81P that is similar to thoracic region 81N (FIG. 22). However, in the lumbar and thoracic regions 82P and 80P, the fabric material is extended to wrap around the tubular side portions of the back frame 36P. This allows the extrusions (240P-245P) to be eliminated. The wrapped flap sections can be sewn to a front panel of the covering near the edges of the back frame 36P, . . . or can be extended to a center area and sewn (as illustrated). Notably, the wrapped flap sections will affect elasticity and stretchability of the material since they cause a double thickness of material, as well as the stitching affects stretchability and elasticity. It is noted that the upper outer corners of the fabric covering are notched at locations 251P to provide a smoother transition around the upper outer corners of the back frame 36P.

Figure 12:
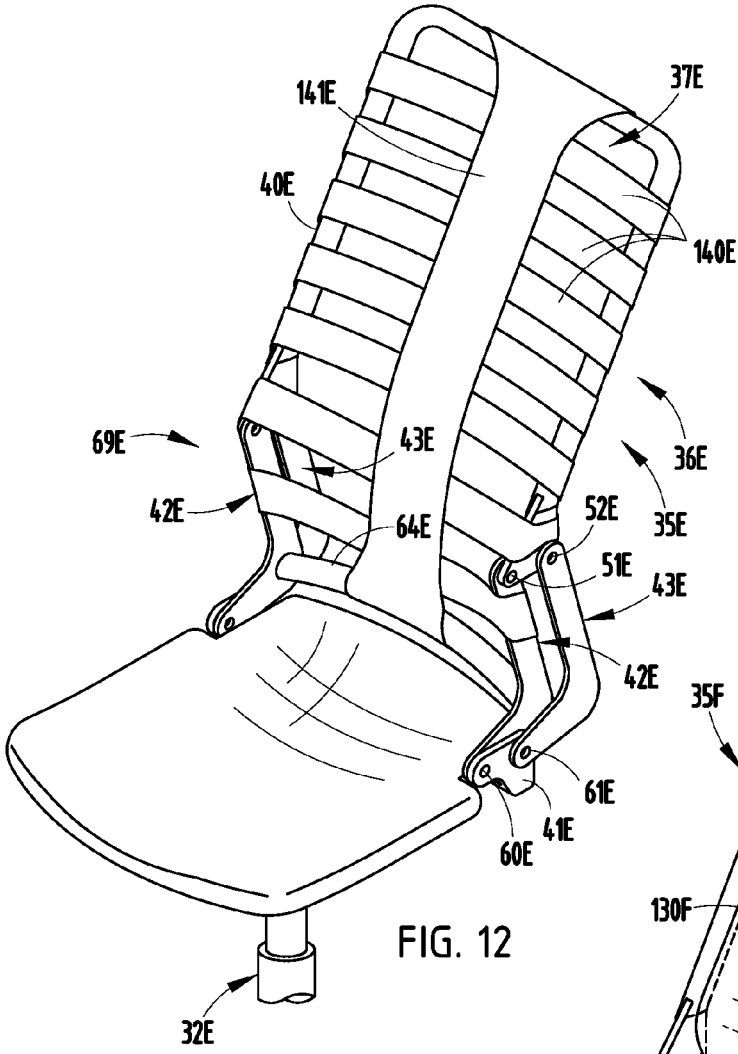
Figure 13:
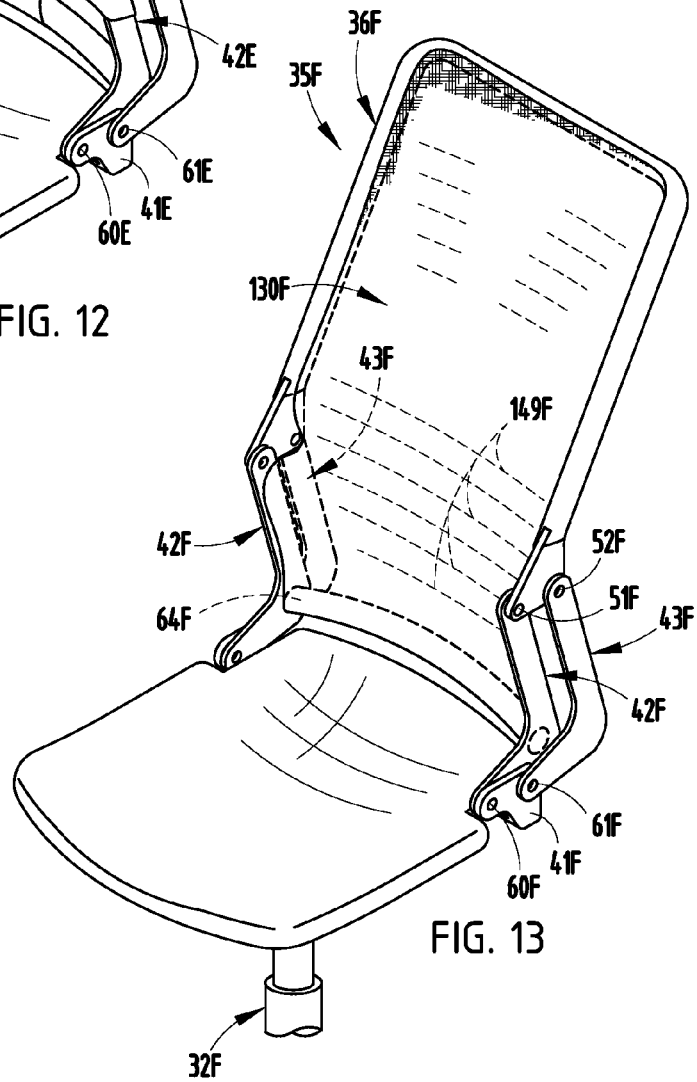
Figure 14:
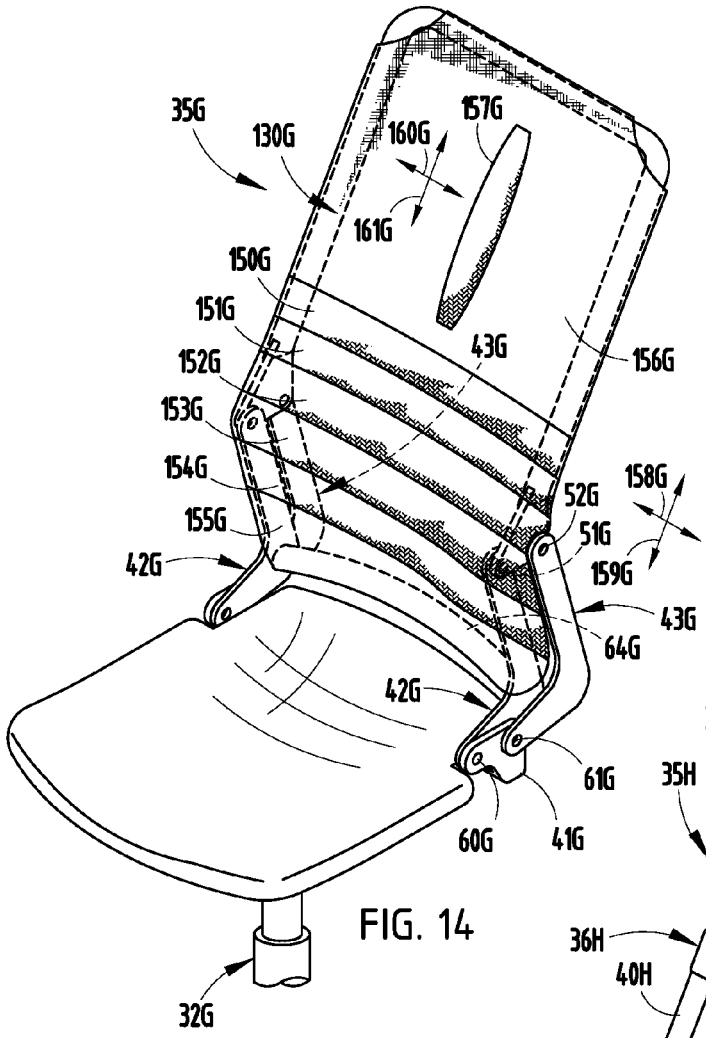
Figure 15:
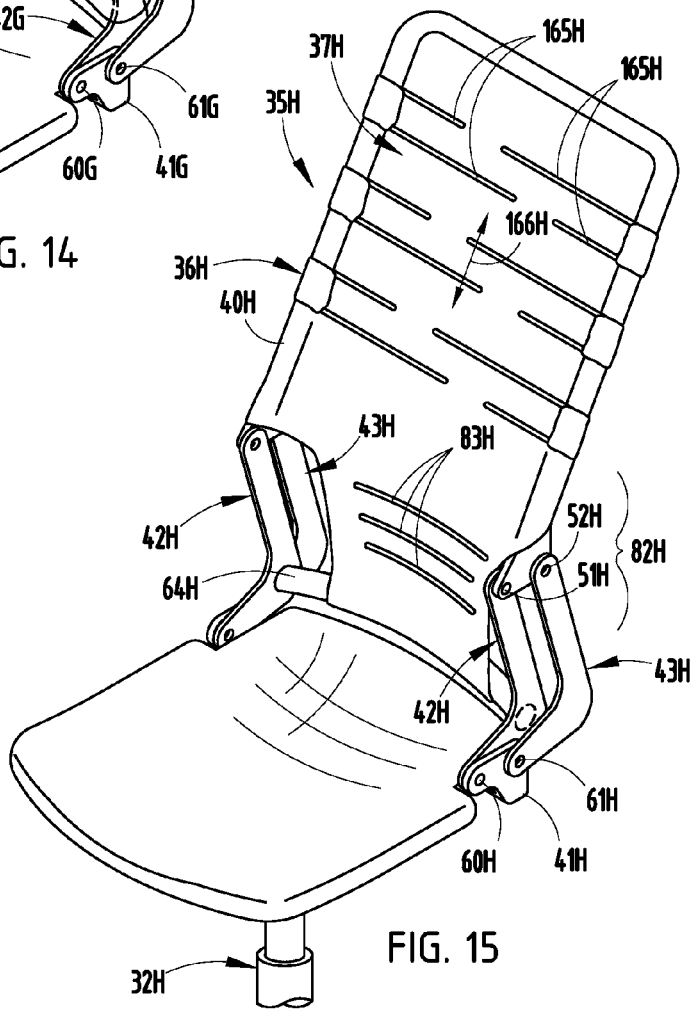
Figure 16:
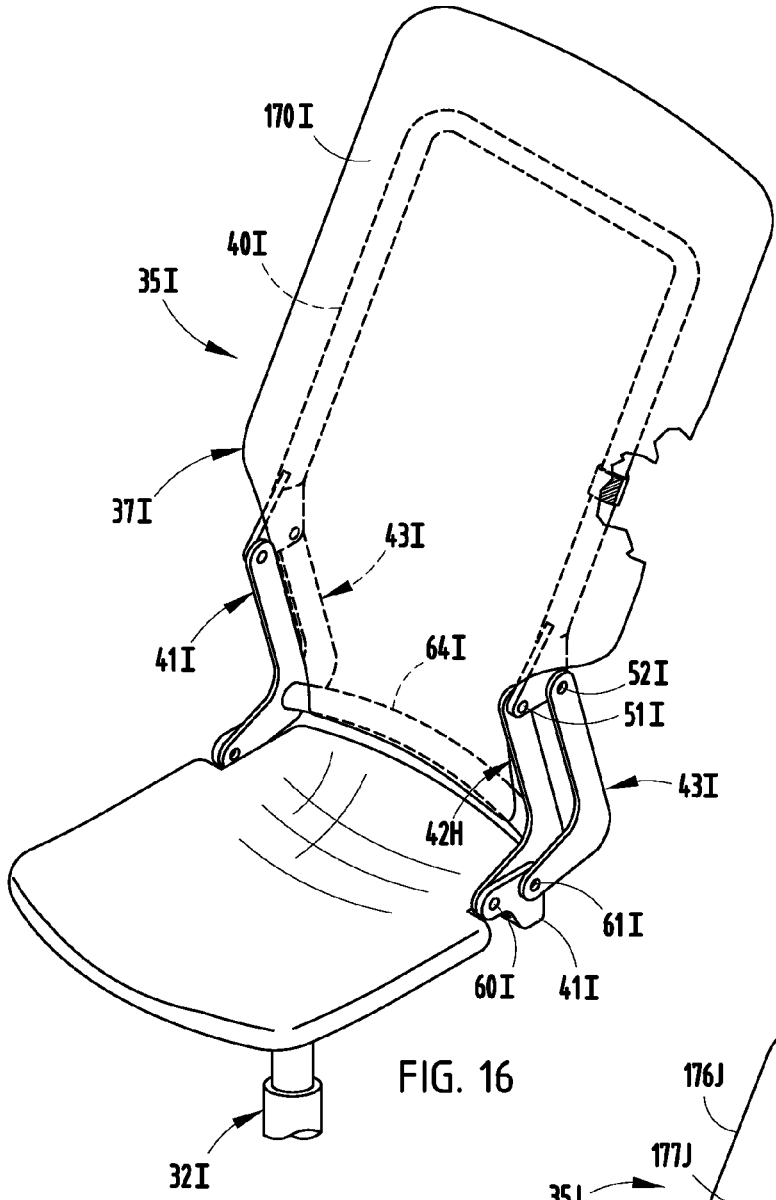

Back support 37Q (FIG. 24) is similar to the back support 37E (FIG. 12). Back support 37Q includes a plurality of horizontal straps 140Q and a centered vertical strap 141Q extending from top to bottom across the horizontal straps 140Q. The horizontal straps 140Q in the thoracic and pelvic regions are relatively unstretchable. The horizontal straps 140Q in the lumbar region are also relatively unstretchable, but may include some stretchability. The vertical strap 141Q is stretchable, such as 4% to 10% or more, sufficient to allow flexure of the back frame 36Q in the lumbar region. The vertical strap 141Q may be attached to the horizontal straps 140Q in order to maintain their spacing and to provide some connection for smooth support to a seated user even when the seated user is moving and flexing within the back. However, it is contemplated that the vertical strap 141Q may work satisfactorily when left unattached, particularly when a cover is applied over the back frame 36Q. Notably, tension on the vertical strap 141Q causes the horizontal straps 140Q to take on a multi-curved potato-chip-like shape.

The back support 37R (FIG. 25) is similar to back support 37P (FIG. 24), but back support 37R includes top and bottom panels 150R and 151R of material, such as the Technofabric referred to above. The back support 37R includes a semi-stretchable vertical strap 141R extending top to bottom of the back frame 36R and that interconnects the top and bottom panels 150R and 151R.

Figure 26:
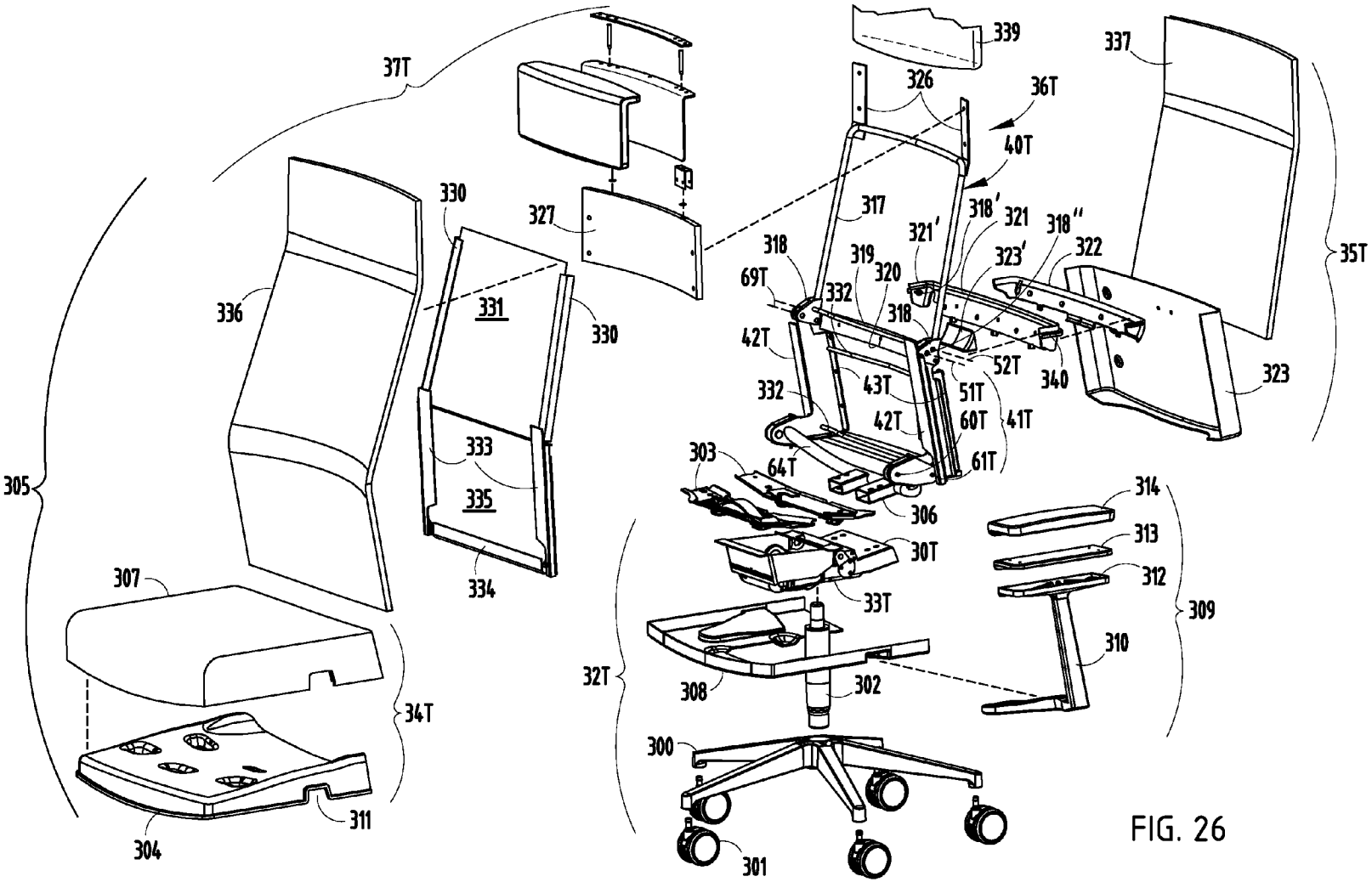
FIGS. 26-26A are exploded perspective views of a chair incorporating an articulating back frame similar to that shown in FIG. 22, FIG. 26A being an enlargement of the back frame and overlapping back covers and related components.
Figure 27:
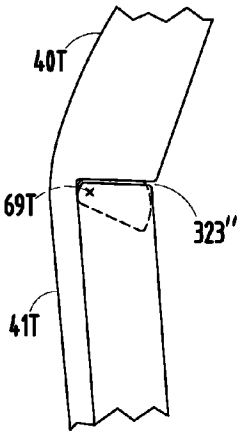
FIGS. 27-28 are schematic side views of the back of FIG. 26, FIG. 27 showing the back in its normal forwardly-curved shape with the lumbar region protruding forwardly, and FIG. 28 showing the back with the lumbar region pressed rearwardly such that the back forms a more planar shape.
Figure 28:
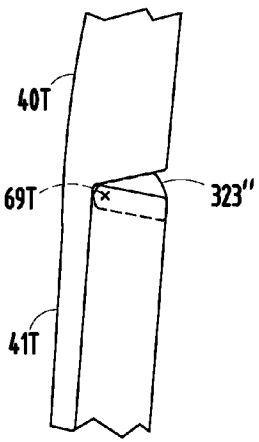
Figure 26A:
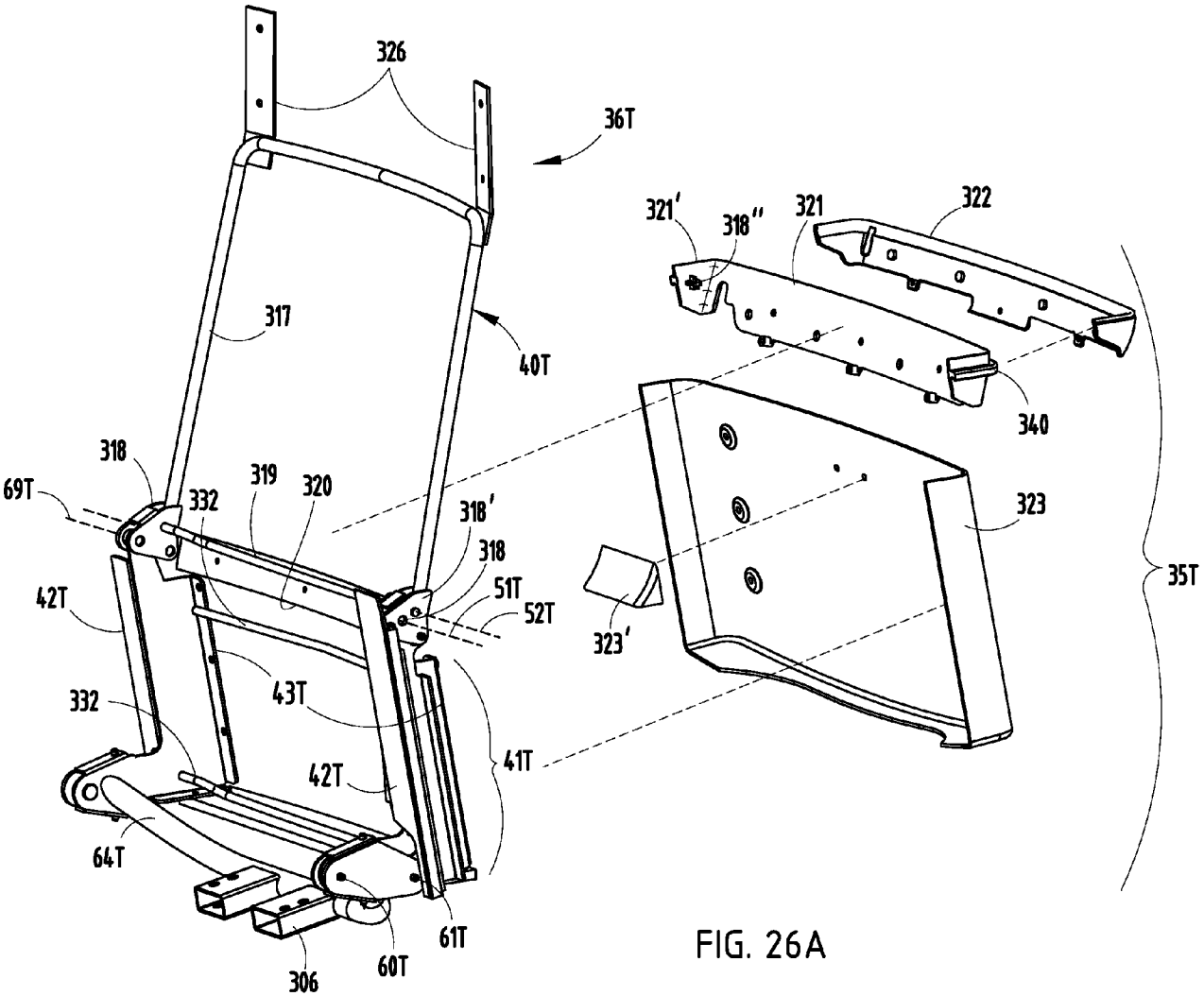

A seating unit 30T (FIG. 26) includes a base 32T with underseat control 33T positioned atop a height-adjustable column, and a seat 34T and back assembly 35T (also called a "back" herein) operably supported on the control 33T for synchrotilt movement upon recline of the back 35T. The back 35T includes an integrated articulating back frame 36T and a back support 37T attached to and supported by the back frame 36T. It is noted that the back frame 36T and back support 37T are similar to the back frame 36N and back support 37N shown in FIG. 22 and discussed above. The back frame 36T has an upper segment 40T and a lower segment 41T pivotally connected by front and rear links 42T and 43T to form a four-bar linkage supporting articulated movement of the upper and lower segments, primarily at lumbar-positioned joint 69T, upon rearward flexure of a seated user's lower back. This movement is independent of recline of the back 35T, yet the structure provides for a slim side profile for aesthetics and also provides excellent continuous lumbar support to the seated user, as previously described.

The illustrated base 32T includes a "spider-legged" base support 300 with castors 301, a vertically-extendable column 302 supported on the support 300, and the underseat control 33T positioned atop the column 302. The illustrated control 33T is shown in Heidmann U.S. Pat. No. 5,873,634 (the entire contents of which are incorporated herein by reference for their teachings), and includes top-mounted brackets 303 for movably supporting the seat frame 304 and includes a rear throat 305 for engaging a forwardly-extending male connector 306 on the back frame 36T. The illustrated seat frame 304 is covered by a top upholstered cushion 307 and a bottom aesthetic cover 308. An armrest 309 includes an L-shaped arm support 310 fastened to a bottom of the seat frame 304 and extending through a notch 311 outwardly from under the seat and then upwardly. The armrest 309 further includes a horizontally-extending anchor plate 312, a supporting retainer 313, and a top cover 314. It is contemplated that the presently disclosed structure can be adapted to work with a variety of different bases, underseat controls, seats, backs and armrests.

The upper back segment 40T includes a perimeter frame formed by an inverted U-shaped rod 317, joint-forming brackets 318 that form joint 69S, and cross bar 319. An attachment strap 320 also extends between the brackets 318, and includes mating/aligned holes for receiving screws to attach the lower fabric support bracket 321. The support bracket 321 includes ends that wrap around onto the joint-forming brackets 318, and include inwardly-extending protrusions 318' that engage mating holes 318" in the brackets 318. A cover 322 is attached to the bracket 321 that covers the bracket 321, and a lower back cover 323 attaches to a rear of the rear links 43T. The cover 323 includes an upper edge that overlaps onto and slidably engages the cover 323, as described below. The covers 322 and 323 form a unique slidingly-extendable overlapping arrangement permitting the back 35T to open and extend vertically when flexing at joint 69T, yet while preventing a pinch point and also while maintaining a high visual appearance.

Optionally, a pair of spaced-apart brackets 326 are attached to a top of the rod 317 and extend upwardly. A panel 327 is attached between the brackets 326 to form a headrest at a top of the back segment 40T. The panel 327 is curved to match a curved top of the rod 317, and to comfortably support a person's head.

The back support 37T includes a plurality of extrusions 330 attached to vertical sides of the rod 317, and a section of fabric material 331 such as three-dimensional fabric material (sometimes called "technofabric material") attached between the extrusions 330.

The lower back segment 41T includes the front and rear links 42T and 43T, with front links 42T pivoted at top and bottom axes 51T and 60T and with rear link 43T pivoted at top and bottom axes 52T and 61T. The top axes 51T and 52T are formed by joint-forming brackets 318. Stabilizer cross braces 332 can be extended between the side portions of rear link 43T as desired for stability and structure.

The back support 37T further includes a plurality of extrusions 333-334 attached to the front links 42T and cross bar 332 and a section of fabric material 335, such as technofabric material, attached between the extrusions 333-334. The sections of fabric 331 and 334 may be formed from a single sheet of material if desired.

As illustrated, a front foam sheet 336 covers a front of the back support 37T and a rear foam sheet 337 covers a rear of the back support 37T, with the front foam sheet 336 extending to a bottom of the lower back segment 41T and the rear foam sheet 337 extending only to a bottom of the upper back segment 40T. An upholstery sock 339 is pulled downwardly over the back frame 36T and back support 37T, and covers all components including the foam sheets 336 and 337. A lower edge of the sock 339 extends down to the support bracket 321, where it is attached. If desired, the support bracket 321 includes a ridge 340 over which the lower edge of the sock 339 extends, with the lower edge being attached below the ridge such as by adhesive and/or staples. This provides a visual line having a clean appearance at and above the ridge. The rear surface of the cover 322 is aesthetically treated and/or surfaces for a desired visual effect. It is contemplated that the surface with include a textured surface and/or vertical ribbing so that, when the joint 69T is flexed rearwardly and the gap 322" opens, the appearance is both interesting and "clean." In particular, the cover 322 aesthetically covers the screw holes and fabric edge on the support bracket 321. A bearing 323' can be attached to a center top area of lower cover 323. The bearing 323' slidably engages a downwardly-protruding finger hanging down from a center of cover 322, such that it prevents the cover 322 from dragging on (and hence becoming scratched by) the overlapping top edge of cover 323.

The lower back cover 323 is a large, molded, panel-like cover with fasteners 343 that attach to the rear links 43T at locations such as 344. The lower back cover 323 is configured to aesthetically cover the lower segment 41T of the back 35T. Upon rearward flexing of the back 35T in the lumbar region at joint 69T, the gap in back of the joint 69T opens up to 1½ inches . . . due to the thickness dimension of the back 35T. However, due to the aesthetic rear surface of the cover 322, the open gap takes on a clean appearance.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A seating unit comprising:

a base;

a seat supported on the base; and a back construction operably supported on the base for movement between an upright position and a recline position; the back construction including a back frame and including a back support defining thoracic, pelvic, and lumbar regions on the back frame in a vertical arrangement where a front surface of the thoracic, pelvic, and lumbar regions define a first curved shape with the lumbar region protruding forwardly; the back frame including at least one multi-link arrangement incorporating components pivotally interconnected to flex and change shape in order to move the lumbar region rearwardly while continuing to support the thoracic and pelvic regions upon receiving a rearward lumbar pressure from a seated user, wherein the components of the back frame include upper and lower segments and at least one pair of links interconnecting the upper and lower segments to form the multi-link arrangement, the components defining at least one flexible pivot-defining joint spaced above a top surface of the seat and located in the lumbar region, so that upon receiving the rearward lumbar pressure, the back support and back frame change from the first curved shape to define a more planar second shape.

2. The seating unit defined in claim 1, wherein the pair of links include front and rear links having different lengths and that form a four bar linkage arrangement with the upper and lower segments.

3. The seating unit defined in claim 1, wherein the components of the back frame form a perimeter frame defining an open area.

4. The seating unit defined in claim 3, wherein the back support includes a suspension material attached to and supported between the perimeter frame across the open area.

5. The seating unit defined in claim 1, wherein the back construction includes at least one rear back cover forming a horizontal feature line and defining an area along the feature line that is hidden when the back construction is in the first curved shape, but that is uncovered and revealed when the back support and back frame are moved toward the more planar second shape.

6. The seating unit defined in claim 5, wherein the at least one rear back cover includes an upper cover and a lower cover with overlapping edges that slidingly engage when the back frame and back support are moved toward the more planar second shape.

7. The seating unit defined in claim 1, wherein a lower portion of the upper segment includes a bracket defining front and rear upper pivots for pivotally engaging a top of the at least one pair of links.

8. The seating unit defined in claim 7, wherein the at least one pair of links include links positioned at outboard sides of the back.

9. The seating unit defined in claim 7, wherein the at least one pair of links includes front and rear links on each side of the back.

* * * * *